US012616345B2

(12) United States Patent
Kim et al.

(10) Patent No.: US 12,616,345 B2
(45) Date of Patent: May 5, 2026

(54) NOZZLE FOR CLEANER

(71) Applicant: LG Electronics Inc., Seoul (KR)

(72) Inventors: Sungjun Kim, Seoul (KR); Jungwan Ryu, Seoul (KR); Jinhyouk Shin, Seoul (KR); Ingyu Yang, Seoul (KR); Jinho Kim, Seoul (KR); Hyeri Kwon, Seoul (KR); Kyoungho Ryou, Seoul (KR); Youngsoo Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 462 days.

(21) Appl. No.: 16/398,783

(22) Filed: Apr. 30, 2019

(65) Prior Publication Data

US 2019/0328196 A1 Oct. 31, 2019

(30) Foreign Application Priority Data

Apr. 30, 2018 (KR) ..... 10-2018-0050059
Apr. 30, 2018 (KR) ..... 10-2018-0050085
Jul. 30, 2018 (KR) ..... 10-2018-0088832

(51) Int. Cl.
*A47L 11/206* (2006.01)
*A47L 9/06* (2006.01)
(Continued)

(52) U.S. Cl.
CPC ..... *A47L 11/206* (2013.01); *A47L 9/068* (2013.01); *A47L 11/4013* (2013.01);
(Continued)

(58) Field of Classification Search
CPC .... A47L 11/206; A47L 9/068; A47L 11/4013; A47L 11/4038; A47L 11/4093;
(Continued)

(56) References Cited

U.S. PATENT DOCUMENTS 6,237,188 B1 5/2001 Takemoto et al.
6,289,551 B1 9/2001 Basile
(Continued)

FOREIGN PATENT DOCUMENTS

CN 2200406 Y 6/1995
CN 2397880 Y 9/2000
(Continued)

OTHER PUBLICATIONS

Korean Notice of Allowance dated Jul. 21, 2020.
(Continued)

*Primary Examiner* — Brian D Keller
*Assistant Examiner* — Aaron R Mcconnell
(74) *Attorney, Agent, or Firm* — Birch, Stewart, Kolasch & Birch, LLP

(57) ABSTRACT

The nozzle of a cleaner includes a nozzle main body which has a suction flow path for suctioning air. A plurality of rotation cleaning units are rotatably connected to the nozzle main body, and a plurality of driving devices drive the plurality of rotation cleaning units. A water tank is mounted on the nozzle main body and supplies water to each of the rotation cleaning units. A water supply flow path supplies water from the water tank to each of the rotation cleaning units.

18 Claims, 25 Drawing Sheets

(51) Int. Cl.
*A47L 11/40* (2006.01)
*A47L 13/22* (2006.01)

(52) U.S. Cl.
CPC ..... *A47L 11/4038* (2013.01); *A47L 11/4083* (2013.01); *A47L 11/4094* (2013.01); *A47L 13/22* (2013.01)

(58) Field of Classification Search
CPC .. A47L 11/4094; A47L 11/201; A47L 11/305; A47L 11/4083
See application file for complete search history.

(56) References Cited

U.S. PATENT DOCUMENTS

| | | | | |
|---|---|---|---|---|
| 6,792,648 | B2 * | 9/2004 | Lee | A47L 9/0411 15/377 |
| 6,823,558 | B2 | 11/2004 | Lee | |
| 6,842,941 | B2 * | 1/2005 | Lee | A47L 9/009 15/325 |
| 7,159,276 | B2 | 1/2007 | Omoto et al. | |
| 7,331,082 | B2 | 2/2008 | Hertrick et al. | |
| 7,334,291 | B2 | 2/2008 | Song et al. | |
| 7,412,750 | B2 | 8/2008 | Oh | |
| 7,640,626 | B2 | 1/2010 | Oh | |
| 7,743,462 | B2 | 6/2010 | Yoo | |
| 8,032,985 | B2 | 10/2011 | Seo | |
| 8,567,003 | B2 | 10/2013 | McLeod et al. | |
| 8,677,552 | B2 | 3/2014 | Krebs | |
| 8,904,595 | B2 | 12/2014 | Davidshofer et al. | |
| 9,265,396 | B1 | 2/2016 | Lu et al. | |
| 9,554,680 | B2 | 1/2017 | Elsdon et al. | |
| 10,123,673 | B2 | 11/2018 | Kim et al. | |
| 10,362,920 | B2 | 7/2019 | Moser et al. | |
| 10,575,692 | B2 | 3/2020 | Lim et al. | |
| 10,582,826 | B2 | 3/2020 | Hwang et al. | |
| 10,602,902 | B2 * | 3/2020 | Ding | A47L 11/282 |
| 10,638,901 | B2 | 5/2020 | Yang et al. | |
| 10,682,035 | B2 | 6/2020 | Ji et al. | |
| 10,898,045 | B2 | 1/2021 | Woo et al. | |
| 10,920,764 | B2 | 2/2021 | Nishimura et al. | |
| 10,952,582 | B2 | 3/2021 | Kim et al. | |
| 10,993,598 | B2 | 5/2021 | Park et al. | |
| 11,006,802 | B2 | 5/2021 | Watanabe et al. | |
| 11,058,278 | B2 | 7/2021 | Shin et al. | |
| 11,096,536 | B2 | 8/2021 | Yang et al. | |
| 11,154,172 | B2 | 10/2021 | Kim et al. | |
| 11,191,415 | B2 | 12/2021 | Yang et al. | |
| 11,730,335 | B1 | 8/2023 | Resch et al. | |
| 11,786,093 | B2 | 10/2023 | Yang et al. | |
| 2001/0027586 | A1 | 10/2001 | Lee | |
| 2002/0112744 | A1 | 8/2002 | Besseling | |
| 2003/0037409 | A1 | 2/2003 | Lee | |
| 2003/0221281 | A1 * | 12/2003 | Oh | A47L 9/0433 15/387 |
| 2004/0163199 | A1 | 8/2004 | Hsu | |
| 2005/0223522 | A1 * | 10/2005 | Song | A47L 9/0081 15/387 |
| 2005/0246853 | A1 | 11/2005 | Pierce et al. | |
| 2006/0042043 | A1 | 3/2006 | Kim | |
| 2007/0067945 | A1 | 3/2007 | Kasper et al. | |
| 2007/0074370 | A1 * | 4/2007 | Oh | A47L 9/0472 15/385 |
| 2007/0157422 | A1 * | 7/2007 | Oh | A47L 9/04 15/387 |
| 2008/0282490 | A1 * | 11/2008 | Oh | A47L 11/4083 15/246.3 |
| 2009/0064447 | A1 | 3/2009 | Oh et al. | |
| 2009/0229069 | A1 | 9/2009 | Lenkiewicz et al. | |
| 2010/0287716 | A1 * | 11/2010 | Kasper | A47L 11/26 15/4 |
| 2012/0110775 | A1 * | 5/2012 | Krebs | A47L 9/0411 15/347 |
| 2013/0121880 | A1 | 5/2013 | Yamazaki | |
| 2015/0113757 | A1 | 4/2015 | Franke et al. | |
| 2015/0128996 | A1 | 5/2015 | Dooley et al. | |
| 2015/0272412 | A1 | 10/2015 | Liscio | |
| 2017/0251897 | A1 | 9/2017 | McDowell et al. | |
| 2018/0055313 | A1 | 3/2018 | Yang et al. | |
| 2018/0192846 | A1 | 7/2018 | Ji et al. | |
| 2019/0038106 | A1 | 2/2019 | Jang et al. | |
| 2019/0223681 | A1 | 7/2019 | Jang et al. | |
| 2019/0328193 | A1 | 10/2019 | Yang et al. | |
| 2019/0328194 | A1 | 10/2019 | Kim et al. | |
| 2019/0328201 | A1 | 10/2019 | Shin et al. | |
| 2019/0328202 | A1 | 10/2019 | Yang et al. | |
| 2020/0029762 | A1 | 1/2020 | Lee et al. | |
| 2021/0045598 | A1 | 2/2021 | Krebs | |
| 2021/0076894 | A1 * | 3/2021 | Wiltshire | A47L 11/4091 |

FOREIGN PATENT DOCUMENTS

| | | | | |
|---|---|---|---|---|
| CN | 1315602 | A | 10/2001 | |
| CN | 1320409 | A | 11/2001 | |
| CN | 2660984 | Y | 12/2004 | |
| CN | 1720850 | A | 1/2006 | |
| CN | 1969729 | A | 5/2007 | |
| CN | 101108086 | A | 1/2008 | |
| CN | 101120867 | A | 2/2008 | |
| CN | 201042408 | Y | 4/2008 | |
| CN | 101305893 | A | 11/2008 | |
| CN | 201162194 | Y | 12/2008 | |
| CN | 101524259 | A | 9/2009 | |
| CN | 101589933 | A | 12/2009 | |
| CN | 102085081 | A | 6/2011 | |
| CN | 102188199 | A | 9/2011 | |
| CN | 101268923 | B | 12/2011 | |
| CN | 102312413 | A | 1/2012 | |
| CN | 102448628 | A | 5/2012 | |
| CN | 102525338 | A | 7/2012 | |
| CN | 102525351 | A | 7/2012 | |
| CN | 102776853 | A | 11/2012 | |
| CN | 103860105 | A | 6/2014 | |
| CN | 203866748 | U | 10/2014 | |
| CN | 104739344 | A | 7/2015 | |
| CN | 104968247 | A | 10/2015 | |
| CN | 204765438 | U | 11/2015 | |
| CN | 105361802 | A | 3/2016 | |
| CN | 105581741 | A | 5/2016 | |
| CN | 205268043 | U * | 6/2016 | |
| CN | 205597859 | U | 9/2016 | |
| CN | 106793900 | A | 5/2017 | |
| CN | 106955064 | A | 7/2017 | |
| CN | 206324739 | U | 7/2017 | |
| CN | 107348894 | A | 11/2017 | |
| CN | 107361692 | A | 11/2017 | |
| CN | 107625493 | A | 1/2018 | |
| CN | 211573011 | U | 9/2020 | |
| CN | 211674011 | U | 10/2020 | |
| DE | 101 57 017 | A1 | 3/2003 | |
| DE | 202010005573 | U1 | 8/2010 | |
| DE | 10 2016 208 895 | A1 | 11/2017 | |
| EP | 0 160 178 | A1 | 11/1985 | |
| EP | 1 582 131 | | 10/2005 | |
| EP | 2 016 882 | | 1/2009 | |
| EP | 2 033 559 | A2 | 3/2009 | |
| EP | 2 255 896 | A2 | 12/2010 | |
| EP | 2 329 755 | | 6/2011 | |
| EP | 24449937 | A2 | 5/2012 | |
| EP | 3 459 412 | | 3/2019 | |
| JP | 10-57289 | A | 3/1998 | |
| JP | 11-4790 | A | 1/1999 | |
| JP | 2006-325761 | A | 12/2006 | |
| JP | 2008-161260 | A | 7/2008 | |
| KR | 97-20795 | U | 6/1997 | |
| KR | 97-53478 | U | 10/1997 | |
| KR | 20-0148059 | Y1 | 6/1999 | |
| KR | 200195057 | Y1 * | 6/2000 | A47L 11/03 |
| KR | 200195057 | | 9/2000 | |
| KR | 10-2001-0093648 | A | 10/2001 | |
| KR | 10-2003-0016520 | A | 3/2003 | |
| KR | 2003-0041569 | A | 5/2003 | |
| KR | 10-0400515 | B1 | 9/2003 | |
| KR | 10-0405244 | | 11/2003 | |

(56) References Cited

FOREIGN PATENT DOCUMENTS

| | | | | |
|---|---|---|---|---|
| KR | 20-0331830 | Y1 | 11/2003 | |
| KR | 2003-0093625 | | 12/2003 | |
| KR | 10-2005-0014652 | A | 2/2005 | |
| KR | 20-0402551 | Y1 | 12/2005 | |
| KR | 10-2006-0032063 | A | 4/2006 | |
| KR | 10-0582285 | B1 | 5/2006 | |
| KR | 10-2006-0064769 | A | 6/2006 | |
| KR | 10-0667875 | | 1/2007 | |
| KR | 10-2008-0020304 | A | 3/2008 | |
| KR | 10-0814507 | B1 | 3/2008 | |
| KR | 10-0822785 | B1 | 4/2008 | |
| KR | 10-0848568 | B1 | 7/2008 | |
| KR | 10-2009-0000937 | A | 1/2009 | |
| KR | 10-2009-0026031 | | 3/2009 | |
| KR | 10-2009-0071509 | A | 7/2009 | |
| KR | 2010-0016787 | A | 2/2010 | |
| KR | 2010-0037469 | | 4/2010 | |
| KR | 10-0956737 | B1 | 5/2010 | |
| KR | 10-2011-0087251 | A | 8/2011 | |
| KR | 10-2012-0110271 | A | 10/2012 | |
| KR | 10-2013-0129059 | A | 11/2013 | |
| KR | 20-2013-0007030 | U | 12/2013 | |
| KR | 10-1408733 | B1 | 6/2014 | |
| KR | 10-2015-0116311 | A | 10/2015 | |
| KR | 10-1578887 | B1 | 12/2015 | |
| KR | 1578887 | B1 * | 12/2015 | ..... A47L 11/282 |
| KR | 10-1595727 | B1 | 2/2016 | |
| KR | 1595727 | B1 * | 2/2016 | ..... A47L 11/145 |
| KR | 2016-0024735 | A | 3/2016 | |
| KR | 10-1623871 | B1 | 5/2016 | |
| KR | 10-2016-0065611 | A | 6/2016 | |
| KR | 10-2016-0088549 | A | 7/2016 | |
| KR | 10-2016-0090571 | A | 8/2016 | |
| KR | 10-2016-0098932 | A | 8/2016 | |
| KR | 10-1655684 | B1 | 9/2016 | |
| KR | 10-1664686 | B1 | 10/2016 | |
| KR | 2016-0150433 | | 12/2016 | |
| KR | 10-2017-0028765 | | 3/2017 | |
| KR | 2017-0028758 | | 3/2017 | |
| KR | 10-2017-0085313 | A | 7/2017 | |
| KR | 10-2017-0086401 | A | 7/2017 | |
| KR | 10-2017-0136856 | A | 12/2017 | |
| KR | 10-1805135 | B1 | 12/2017 | |
| KR | 10-2018-0008248 | A | 1/2018 | |
| KR | 10-2018-0023401 | | 3/2018 | |
| KR | 10-2018-0098530 | A | 9/2018 | |
| TW | 123375 | | 11/1989 | |
| TW | 201002262 | A1 | 1/2010 | |
| TW | M469865 | | 1/2014 | |
| TW | I483856 | B | 5/2015 | |
| TW | 201607490 | A | 3/2016 | |
| TW | I568402 | B | 2/2017 | |
| TW | 201707632 | A | 3/2017 | |
| TW | 201707639 | A | 3/2017 | |
| TW | 201707640 | A | 3/2017 | |
| TW | 201720359 | | 6/2017 | |
| TW | 201731443 | | 9/2017 | |
| TW | 201740856 | | 12/2017 | |
| TW | 201740857 | | 12/2017 | |
| TW | 201740861 | | 12/2017 | |
| TW | 201740868 | A | 12/2017 | |
| TW | I618519 | B | 3/2018 | |
| TW | 201838576 | A | 11/2018 | |
| WO | WO 01/07719 | A1 | 2/2001 | |
| WO | WO 2005/011461 | A1 | 2/2005 | |
| WO | WO 2010/016660 | A1 | 2/2010 | |
| WO | WO 2011/005027 | | 1/2011 | |
| WO | WO 2012/014620 | | 2/2012 | |
| WO | WO 2013/090143 | | 6/2013 | |
| WO | WO 2014/080181 | | 5/2014 | |
| WO | WO 2016/190565 | | 1/2016 | |
| WO | WO 2016/021419 | | 2/2016 | |
| WO | WO 2016/031704 | | 3/2016 | |
| WO | WO 2016/107634 | | 7/2016 | |
| WO | WO2017/007152 | A | 1/2017 | |
| WO | WO 2018/012912 | A1 | 1/2018 | |
| WO | WO-2019129362 | A1 * | 7/2019 | ..... A47L 1/08 |

OTHER PUBLICATIONS

OA 048 AU Sep. 27, 2019 (2019100837) issued Sep. 27, 2019.
International Search Report PCT/KR2019/004827 dated Apr. 30, 2018.
International Search Report PCT/KR2019/004829 dated Apr. 30, 2018.
International Search Report PCT/KR2019/004931 dated Apr. 30, 2018.
International Search Report PCT/KR2019/004932 dated Apr. 30, 2018.
International Search Report PCT/KR2019/004933 dated Apr. 30, 2018.
Taiwanese Office Action dated Nov. 11, 2020.
Taiwanese Search Report dated Apr. 30, 2018.
Chinese Office Action in Chinese Application No. 201980026813.9 dated May 11, 2021 (7 pages).
Office Action issued by the Korean Patent Office in Application No. KR 10-0400515 (54 p).
Chinese Office Action in Chinese Application No. 201980026789.9 dated May 21, 2021 (8 pages).
Notice of Allowance issued May 13, 2021 on Taiwanese Application No. 108114573.
Notice of Allowance issued May 13, 2021 on Taiwanese Application No. 108114579.
Korean Office Action dated Apr. 22, 2021 on Korean Application No. 10-2021-0037376.
Korean Office Action dated Apr. 23, 2021 on Korean Application No. 10-2021-0037380.
Korean Office Action dated Mar. 26, 2021 on Korean Application No. 10-2021-0034566.
Office Action issued on Sep. 15, 2021, in U.S. Appl. No. 16/524,759.
Notice of Allowance in Korean Application No. 10-2021-0047134, dated Dec. 6, 2021, (2 pages).
European Search Report in European Application No. 19796167.5, dated Jan. 5, 2022 (7 pages).
Office Action in Taiwanese Application No. 110129697, dated Jan. 22, 2022 (13 pages).
Australian Notice of Allowance dated Aug. 17, 2022 for Application No. 2019263346.
Korean Office Action dated Jun. 21, 2022 for Application No. 10-2022-0012767.
Zhao et al., "Structural Analyses of Web Cleaner Based on Computational Fluid Dynamics," Cotton Textile Technology, Dec. 2017, pp. 23-27, with an English abstract.

* cited by examiner

NOZZLE FOR CLEANER

CROSS-REFERENCE TO RELATED APPLICATIONS

This application claims priority under 35 U.S.C. § 119 to Korean Patent Application No. 10-2018-0050059, filed in Korea on Apr. 30, 2018, Korean Patent Application No. 10-2018-0050085, filed in Korea on Apr. 30, 2018, and Korean Patent Application No. 10-2018-0088832, filed in Korea on Jul. 30, 2018, the contents of all of which are hereby incorporated by reference in their entireties.

BACKGROUND

The present specification relates to a nozzle for a cleaner.

The cleaner is a device which suctions or wipes dust or foreign matter in a region to be cleaned to perform a cleaning.

Such a cleaner can be classified into a manual cleaner for performing cleaning while a user directly moves the cleaner and an automatic cleaner for performing cleaning while traveling itself.

The manual cleaner can be classified into a canister-type cleaner, an upright-type cleaner, a handy-type cleaner, and a stick-type cleaner, according to the type of the cleaner.

These cleaners can clean a floor using nozzles. In general, nozzles can be used so as to suction air and dust. According to the type of the nozzle, the nozzle may be attached with a mop to clean a floor with the mop.

Korean Patent Registration No. 10-0405244, which is a related art 1, discloses a suction port assembly for a vacuum cleaner.

The suction port assembly of the related art 1 includes a suction port main body provided with a suction port.

The suction port main body includes a first suction path in the front, a second suction path in the rear, and a guide path formed between the first suction path and the second suction path.

A mop is rotatably installed on the lower end of the suction port main body, and a rotation driving unit for driving the mop is provided in the suction port main body.

The rotation driving unit includes one rotation motor and gears for transmitting the power of one rotation motor to a plurality of rotating bodies to which mops are attached.

Meanwhile, according to the related art 1, since a pair of rotating bodies disposed on both sides of the rotation driving unit are rotated using one rotating motor, if the rotating motor fails or malfunctions, there is a problem that all of the pair of rotating bodies cannot be rotated.

In addition, so as to rotate the pair of rotating bodies using the one rotation motor, since the rotation motor is positioned at the center of the suction port main body, it is necessary to design a suction path for preventing interference with the rotation motor, and thus there are disadvantages that the length of the suction path is lengthened and the structure for forming a suction path is complicated.

In addition, since the related art 1 does not have a structure for supplying water to a mop, in a case where cleaning is desired to be performed using a mop with water, there is a disadvantage that a user has to directly supply water to a mop.

In addition, in a case of the related art 1, since the rotation motor is positioned at the central portion of the suction port main body, it is difficult to form the suction path in the central portion of the suction port main body and if the suction path is formed in the center portion of the suction port main body, there is a disadvantage that the height of the suction port main body is increased.

In a case where the height of the suction port main body is increased, there are disadvantages that the suction port main body does not easily enter under the furniture or narrow space and thereby the cleanable area is reduced, and the size of the suction port main body is enlarged as a whole, and thus there is a disadvantage that it inconveniences the user during operation.

For example, in a case where the user intends to straighten the suction port main body but the suction port main body is moved eccentrically, there is a disadvantage that the amount of eccentricity is further increased due to the weight of the suction port main body and thus it is difficult for the user to overcome the eccentricity and move the suction port main body back to the original straight path.

On the other hand, Korean Patent Laid-Open Publication No. 10-2017-0028765, which is the related art 2, discloses a cleaner.

The cleaner disclosed in the related art 2 includes a cleaner main body in which a mop is rotatably installed on a lower portion thereof, a water bottle which is mounted to a handle which is connected to the cleaner main body or the cleaner main body, a water spray nozzle which is installed so as to spray water to the front of the cleaner main body, and a water supply unit for supplying the water in the water tank to the water spray nozzle.

In a case of the related art 2, since the water spray nozzle is sprayed forward from a front surface of the cleaner main body, there is a possibility that the sprayed water may wet other nearby structures, not a mop.

The water spray nozzle is disposed at the center of the cleaner main body, while the mop is arranged in the lateral direction, there is a problem that the mop cannot sufficiently absorb the water sprayed forward of the cleaner main body.

In addition, in a case of the related art 2, since there is no flow path for suctioning air, there is a disadvantage that only the floor can be wiped, and foreign matters present on the floor have to be manually cleaned again by the user.

SUMMARY

The present embodiment provides a nozzle for a cleaner which can suction foreign matters on the floor while making the overall size of the nozzle small and slim, clean the floor by rotating a mop and supply water to the mop.

The present embodiment provides a nozzle for a cleaner in which water in a water tank can be stably supplied to a rotation cleaning unit during a cleaning process.

The present embodiment provides a nozzle for a cleaner in which the length of an air flow path for air to flow is prevented from being increased, thereby reducing the flow path loss, even when a structure capable of wiping the floor using the mop is applied.

The present embodiment provides a nozzle for a cleaner in which the volume of water stored in the water tank can be increased while minimizing the height increase of the nozzle.

The present embodiment provides a nozzle for a cleaner that can increase a cleaning area by a mop even with a small amount of movement during cleaning using a nozzle.

The present embodiment provides a nozzle for a cleaner in which the weight of a plurality of driving devices is uniformly distributed to left and right.

The present embodiment provides a nozzle for a cleaner in which the center of gravity of the nozzle is prevented from leaning toward a side of the driving unit in a state where the water tank is mounted.

The present embodiment provides a nozzle for a cleaner in which water discharged through a water supply flow path is prevented from being drawn into the nozzle main body.

The present embodiment provides a nozzle for a cleaner in which the length of the water supply flow path for supplying water in the water tank to the rotation cleaning unit is minimized.

The present embodiment provides a nozzle for a cleaner in which leakage of water discharged from a water tank is minimized.

The present embodiment provides a nozzle for a cleaner in which the same amount of water can be supplied to each of the rotation cleaning units.

The nozzle of a cleaner according to one aspect of the present embodiment includes a nozzle main body which has a suction flow path for suctioning air, a plurality of rotation cleaning units which are rotatably connected to the nozzle main body, a plurality of driving devices for driving the plurality of rotation cleaning units, a water tank which is mounted on the nozzle main body and supplies water to each of the rotation cleaning units, and a water supply flow path for supplying the water in the water tank to each of the rotation cleaning units.

The plurality of rotation cleaning units may include a first rotation cleaning unit and a second rotation cleaning unit, which are arranged on the lower side of the nozzle main body so as to be spaced apart from each other in a lateral direction and each includes a rotation plate to which a mop can be attached.

The plurality of driving devices may include a first driving device which drives the first rotation cleaning unit and is disposed at one side of the flow path of the suction flow paths, which extends in the front and rear direction, and a second driving device which drives the second rotation cleaning unit and is disposed at the other side of the flow path of the suction flow paths, which extends in the front and rear direction.

The water tank may be detachably mounted on the upper side of the nozzle main body.

The water supply flow path may be provided in the nozzle main body.

The suction flow path may include a first flow path extending at a front end portion of the nozzle main body in the lateral direction, and a second flow path extending at a central portion of the first flow path in the front and rear direction.

The first and second driving devices may be positioned behind the first flow path.

The second flow path may be positioned between the first driving device and the second driving device.

The first and second rotation cleaning units may be positioned behind the first flow path.

A central axis bisecting the front and rear length of the nozzle main body may be positioned closer to the rotational center of each of the rotational cleaning units than the first flow path.

The first driving device may include a first driving motor, and the second driving device may include a second driving motor.

The driving motors may be disposed such that the axis of the first driving motor and the axis of the second driving motor extend in the front and rear direction.

An imaginary line connecting the axis of the first driving motor and the axis of the second driving motor may pass through the second flow path.

The first rotation cleaning unit may include a first rotation plate having a first rotation center, to which a mop can be attached, and the second rotation cleaning unit may include a second rotation plate having a second rotation center, to which a mop can be attached.

An axis of the first driving motor and an axis of the second driving motor may be positioned between the first rotation center and the second rotation center.

The respective driving motors may be positioned between the first rotation center and the second rotation center.

Each of the driving devices may further include a driving gear connected to and rotated by a shaft of each of the driving motors.

Each of the driving gears may be disposed between the first flow path and the respective driving motors.

Each of the driving motors may be disposed so as to overlap with an imaginary line connecting the first rotation center and the second rotation center in a vertical direction.

The nozzle main body may include a nozzle housing in which the respective driving devices are received.

The nozzle housing may include a driving unit cover which covers each of the driving devices and protrudes upward. In a state where the water tank is mounted on the nozzle main body, a portion of the water tank may surround the periphery of the driving unit cover.

At least a portion of the bottom of the water tank may be positioned lower than the axis of each of the driving motors in a state where the water tank is mounted on the nozzle main body.

The nozzle housing may include a nozzle base on which the respective driving devices are mounted, and a nozzle cover which is coupled to the nozzle base to cover the respective driving devices and includes the respective driving unit covers.

The water tank may include a receiving space having a recessed form for receiving the respective driving unit cover.

The nozzle cover may further include a flow path cover covering the second flow path. The water tank may include a slot in which the flow path cover is positioned.

A portion of the water tank may be positioned on both sides of the flow path cover.

The water tank may include a first chamber positioned above the first driving motor, a second chamber positioned above the second driving motor, and a connection chamber connecting the first chamber and the second chamber between the first flow path and each of the driving motors.

The mop is attached to the lower side of the rotation plate, and the rotation plate may be provided with a plurality of water passage holes through which the water discharged from the water supply flow path passes.

The plurality of water passage holes may be spaced apart from each other in the circumferential direction with respect to a rotation center of the rotation plate.

An end portion of the water supply flow path is provided with a spray nozzle, and a nozzle end portion of the spray nozzle may be disposed to face the rotation plate.

The nozzle end portion of the spray nozzle may be exposed to the outside of the nozzle housing through the lower side of the nozzle housing.

The nozzle housing may include a groove having a recessed form so as to position a nozzle end portion exposed to the outside of the nozzle housing, and a nozzle hole through which the nozzle end passes may be formed in the groove.

The water tank may include a tank body having a chamber in which water is stored and a discharge port through which water is discharged, and a valve having an opening and closing unit for opening and closing the discharge port in the tank body.

The nozzle main body may include a valve operating unit that operates the opening and closing unit in a process of mounting the water tank to the nozzle main body so that the opening and closing unit opens the discharge port. The water supply flow path may be connected to the valve operating unit.

The water supply flow path may include a water pump for pumping water, and the water pump may be driven by a pump motor.

The water supply flow path may include a supply tube through which water discharged from the water tank flows, a connector which is connected to the supply tube, a first branch tube which is connected to the connector and supplies water to the first rotation cleaning unit, and a second branch tube which is connected to the connector and supplies water to the second rotation cleaning unit.

A spray nozzle may be disposed in each of the first branch tube and the second branch tube. The nozzle end portion of the spray nozzle may be disposed so as to face the respective rotation cleaning units.

The supply tube may include a first supply tube which is connected to the inlet of the water pump and a second supply tube which is connected to the outlet of the water pump and the connector.

The second flow path may divide the nozzle main body into left and right, and the discharge port and the water pump may be positioned at one side of the left and right sides of the second flow path.

The connector may be positioned directly above the second flow path.

DETAILED DESCRIPTION OF THE EMBODIMENTS

Figure 1:
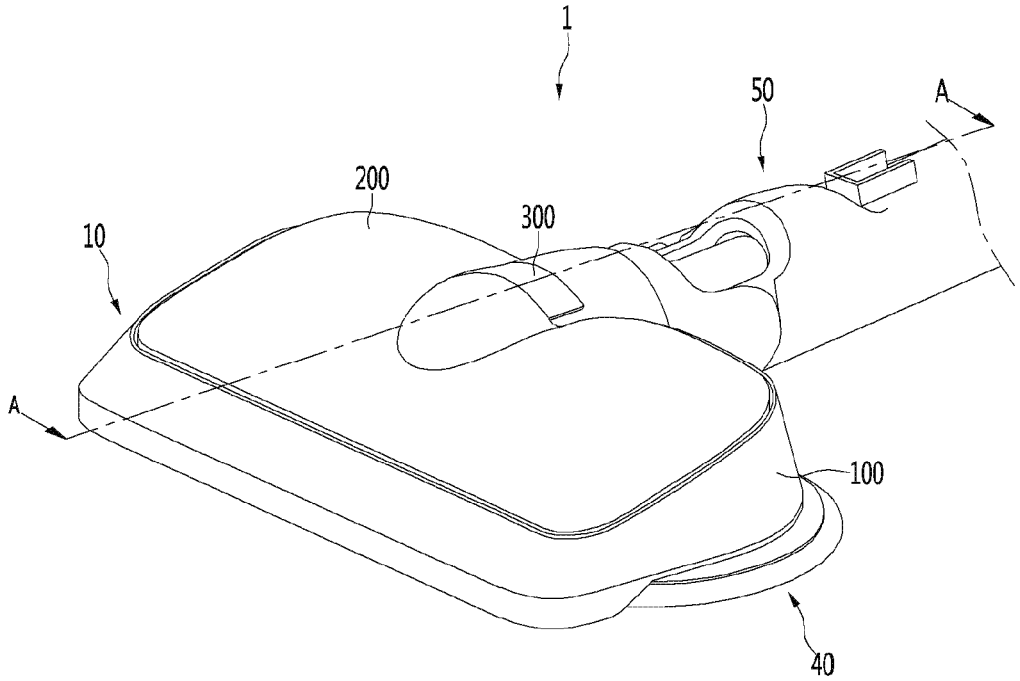
FIG. 1 and FIG. 2 are perspective views illustrating a nozzle for a cleaner according to an embodiment of the present invention.
Figure 2:
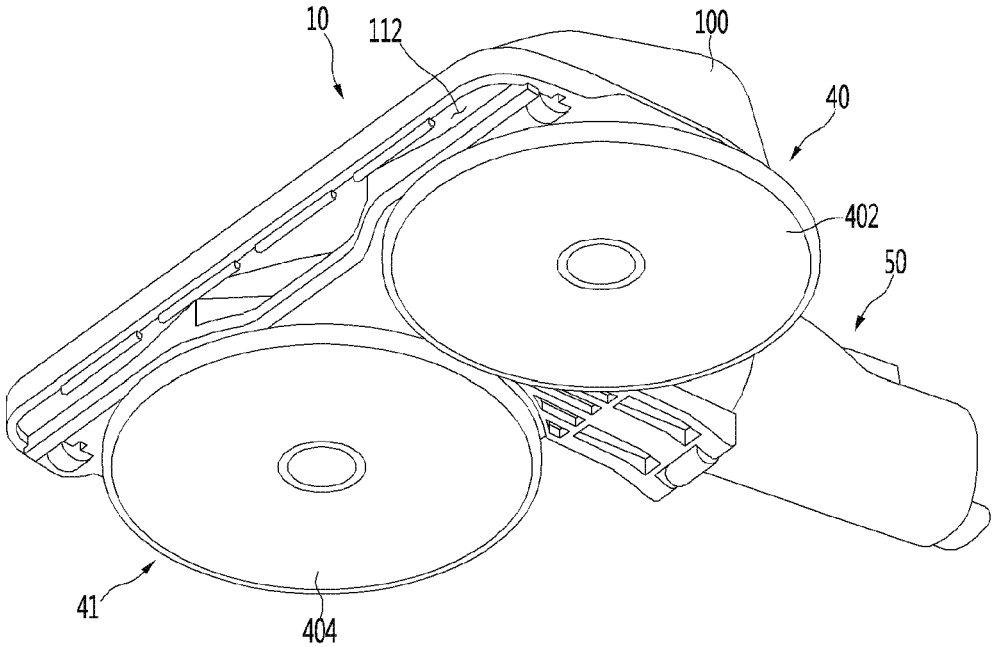
Figure 3:
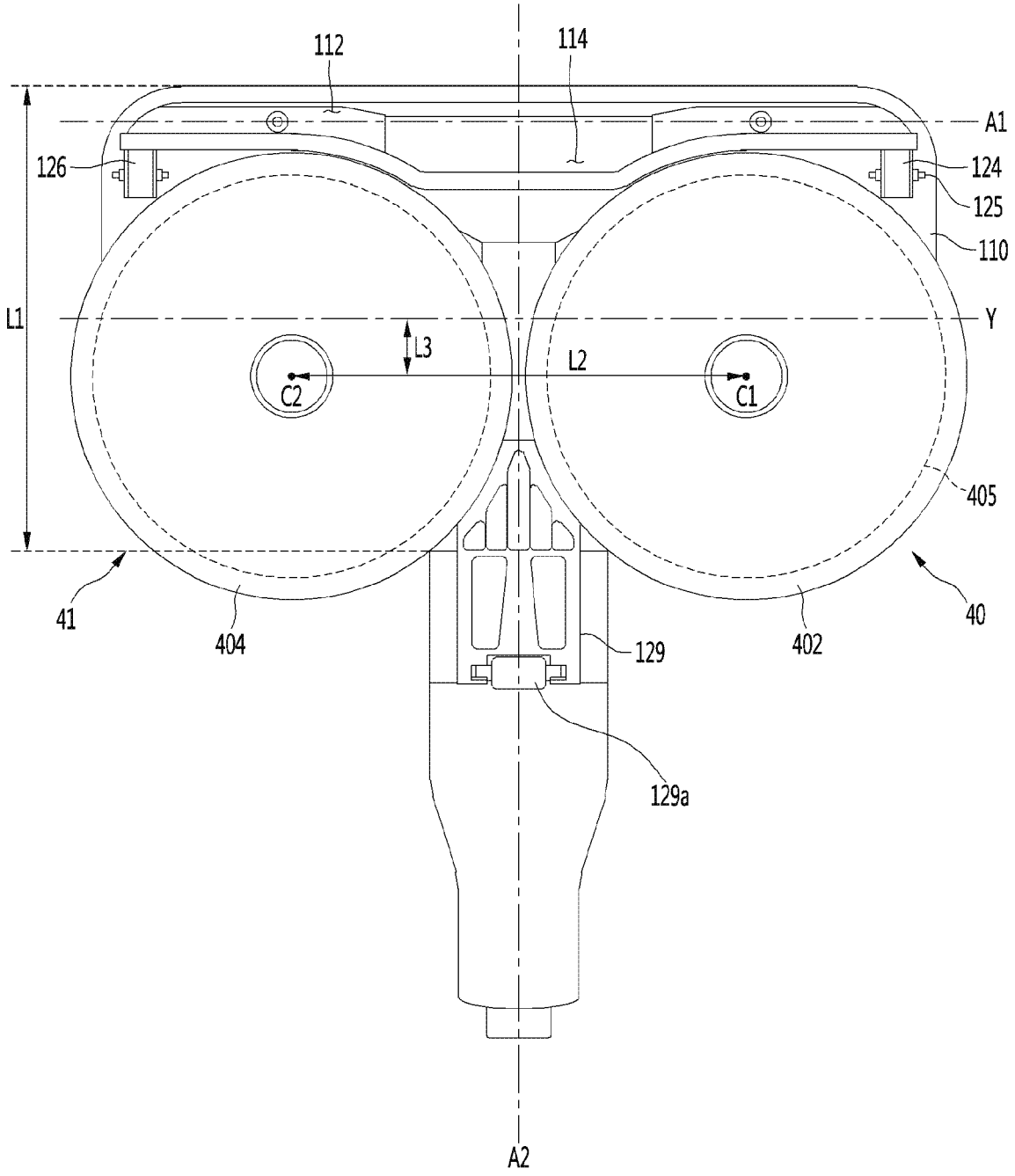
FIG. 3 is a bottom view illustrating a nozzle for a cleaner according to an embodiment of the present invention.
Figure 4:
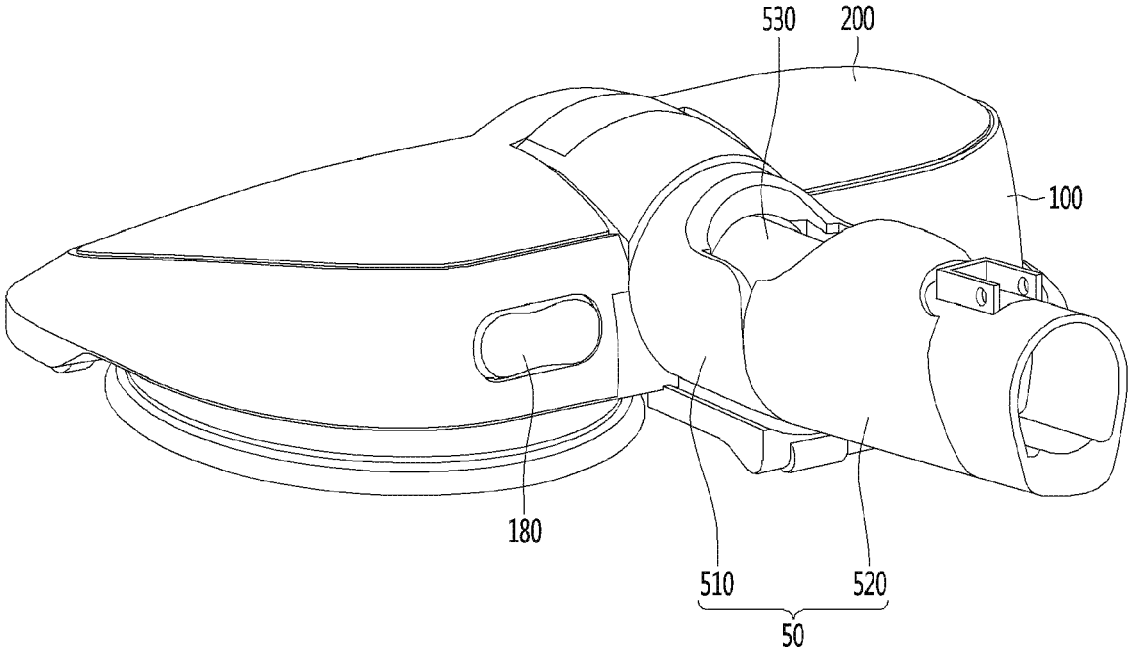
FIG. 4 is a perspective view illustrating the nozzle for the cleaner of FIG. 1 viewed from the rear side.
Figure 5:
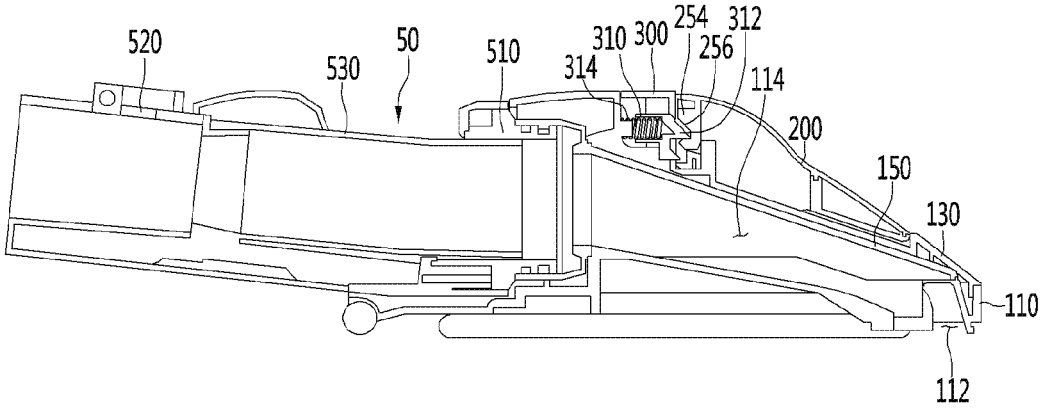
FIG. 5 is a sectional view taken along line A-A of FIG. 1.

FIG. 1 and FIG. 2 are perspective views illustrating a nozzle for a cleaner according to an embodiment of the present invention, FIG. 3 is a bottom view illustrating a nozzle for a cleaner according to an embodiment of the present invention, FIG. 4 is a perspective view illustrating the nozzle for the cleaner of FIG. 1 viewed from the rear side, and FIG. 5 is a sectional view taken along line A-A of FIG. 1.

Referring to FIG. 1 to FIG. 5, a nozzle 1 of a cleaner (hereinafter referred to as "nozzle") according to an embodiment of the present invention includes a nozzle main body 10, and a connection tube 50 which is connected to the nozzle main body 10 so as to be capable of moving.

The nozzle 1 of the present embodiment can be used, for example, in a state of being connected to a handy type cleaner or connected to a canister type cleaner.

The nozzle 1 itself has a battery to supply power to the power consumption unit, or can be operated by receiving power from the cleaner.

Since the cleaner to which the nozzle 1 is connected includes a suction motor, a suction force generated by the suction motor applies to the nozzle 1 to be capable of suctioning foreign matter and air on the bottom surface at the nozzle 1.

Accordingly, in the present embodiment, the nozzle 1 can perform a function of suctioning foreign matter and air on the floor and guiding the foreign matter and air to the cleaner.

Although not limited thereto, the connection tube 50 is connected to the rear central portion of the nozzle main body 10 to guide the suctioned air to the cleaner.

The nozzle 1 may further include rotation cleaning units 40 and 41 rotatably disposed below the nozzle main body 10.

For example, a pair of rotation cleaning units 40 and 41 may be arranged in the lateral direction. The pair of rotation cleaning units 40 and 41 can be independently rotated. For example, the nozzle 1 may include a first rotation cleaning unit 40 and a second rotation cleaning unit 41.

Each of the rotation cleaning units 40 and 41 may include mops 402 and 404. The mops 402 and 404 may be formed in a disc shape, for example. The mops 402 and 402 may include a first mop 402 and a second mop 404.

The nozzle main body 10 may include a nozzle housing 100 forming an outer shape. The nozzle housing 100 may form a suction flow path 112 and 114 for suctioning air.

The suction flow path 112 and 114 include a first flow path 112 extending in the lateral direction in the nozzle housing 100 and a second flow path 114 communicating with the first flow path 112 and extending in the front and rear direction.

The first flow path 112 may be formed at a front end portion of the lower surface of the nozzle housing 100, as an example.

The second flow path 114 may extend rearward from the first flow path 112. For example, the second flow path 114 may extend rearward from the central portion of the first flow path 112 toward the connection tube 50.

Accordingly, a centerline A1 of the first flow path 112 can extend in the lateral horizontal direction. A centerline A2 of the second flow path 114 extends in the front and rear direction and intersects the centerline A1 of the first flow path 112.

The centerline A2 of the second flow path 114 may be positioned at a position where the nozzle main body 10 is bisected right and left, as an example.

A portion of the mops 402 and 404 is protruded to the outside of the nozzle 1 in a state where the rotation cleaning units 40 and 41 are connected to the lower side of the nozzle main body 10 and thus the rotation cleaning units 40 and 41 can clean not only a floor positioned directly below the nozzle but also the floor positioned outside the nozzle 1.

For example, the mops 402 and 404 may protrude not only to both sides of the nozzle 1 but also to the rear of the nozzle 1.

The rotation cleaning units 40 and 41 may be positioned on the rear side of the first flow path 112 from below the nozzle main body 10, for example.

Therefore, when the nozzle 1 is advanced and cleaned, the floor can be cleaned by the mops 402, 404 after foreign substances and air on the floor are suctioned by the first flow path 112.

In the present embodiment, the first rotation center C1 of the first rotation cleaning unit 40 (for example, rotation center of rotation plate 420) and the second rotation center C2 of the second rotation cleaning unit 41 (for example, rotation center of rotation plate 440) are disposed in a state of being spaced apart from each other in the lateral direction.

The centerline A2 of the second flow path 114 may be positioned in a region between the first rotation center C1 and the second rotation center C2.

The central axis Y bisecting the front and rear length L1 of the nozzle main body 10 (except for extension portion) can be positioned forward of the rotational centers C1 and C2 of the respective rotation cleaning units 40 and 41.

The rotation centers C1 and C2 of the respective rotation cleaning units 40 and 41 may be positioned farther from the front end portion of the nozzle main body 10 than the central axis Y bisecting the front and rear length L1 of the nozzle main body 10. This is to prevent the rotation cleaning units 40, 41 from blocking the first flow path 112.

Accordingly, the distance L3 between the central axis Y and the rotation centers C1 and C2 of the respective rotation cleaners 40 and 41 may be set to a value greater than zero.

In addition, the distance L2 between the rotation centers C1 and C2 of the rotation cleaning units 40 and 41 may be formed to be larger than the diameter of each of the mops 402 and 404. This is to prevent the mops 402 and 404 from interfering with each other during the rotation and to prevent the area which can be cleaned by the interfered portion from being reduced.

The diameter of the mops 402 and 404 is preferably 0.6 times or more than half the width of the nozzle main body 10, although not limited thereto. In this case, the area where the mops 402 and 404 can clean the floor facing the nozzle main body 10 is increased, and the area for cleaning the floor not facing the nozzle main body 10 is also increased. In addition, the cleaning area by the mops 402 and 404 can be secured even with a small amount of movement when the nozzle 1 is used for cleaning.

In addition, the mops 402, 404 may be provided with a sewing line 405. The sewing lines 405 may be positioned in a state of being spaced apart inwardly in the center direction at the edge portion of the mops 402 and 404. The mops 402 and 404 may be formed by combining a plurality of fiber materials, and the fiber materials may be joined by the sewing line 405.

At this time, the diameters of the rotation plates 420 and 440, which will be described later, may be larger than the diameter to a portion of the sewing line 405 with respect to the centers of the mops 402 and 404. The diameters of the rotation plates 420 and 440 may be smaller than the outer diameters of the mops 402 and 404.

In this case, the rotation plates 420 and 440 can support a portion of the mops 402 and 404 positioned outside the sewing line 405, thereby reducing the distance between the mops 402 and 404, and it is possible to prevent mutual friction between the mops 402 and 404 or vertical overlapping between the mops 402 and 404 due to the deformation of the mops 402 and 404 by pressing the edge portions.

The nozzle housing 100 may include a nozzle base 110 and a nozzle cover 130 coupled to the upper side of the nozzle base 110.

The nozzle base 110 may form the first flow path 112. The nozzle housing 100 may further include a flow path forming portion 150 forming the second flow path 114 together with the nozzle base 110.

The flow path forming portion 150 may be coupled to the upper center portion of the nozzle base 110 and the end portion of the flow path forming portion 150 may be connected to the connection tube 50.

Accordingly, since the second flow path 114 can extend substantially in a straight line shape in the front and rear direction by the disposition of the flow path forming portion 150, the length of the second flow path 114 can be minimized, and thus the flow path loss in the nozzle 1 can be minimized.

The front portion of the flow path forming portion 150 may cover the upper side of the first flow path 112. The flow path forming portion 150 may be disposed to be inclined upward from the front end portion toward the rear side.

Therefore, the height of the front portion of the flow path forming portion 150 may be lower than that of the rear portion of the flow path forming portion 150.

According to the present embodiment, since the height of the front portion of the flow path forming portion 150 is low, there is an advantage that the height of the front portion of the entire height of the nozzle 1 can be reduced. The lower the height of the nozzle 1, the more likely it is that the nozzle 1 can be drawn into a narrow space on the lower side of furniture or a chair to be cleaned.

The nozzle base 110 may include an extension portion 129 for supporting the connection tube 50. The extension portion 129 may extend rearward from the rear end of the nozzle base 110.

The connection tube 50 may include a first connection tube 510 connected to an end of the flow path forming portion 150, a second connection tube 520 rotatably connected to the first connection tube 510, and a guide tube 530 for communicating the first connection tube 510 with the second connection tube 520.

The first connection tube 510 may be seated on the extension portion 129 and the second connection tube 520 may be connected to an extension tube or hose of the cleaner.

A plurality of rollers for smooth movement of the nozzle 1 may be provided on the lower side of the nozzle base 110.

For example, the first roller 124 and the second roller 126 may be positioned behind the first flow path 112 on the nozzle base 110. The first roller 124 and the second roller 126 may be spaced apart from each other in the lateral direction.

According to the present embodiment, the first roller 124 and the second roller 126 are disposed behind the first flow path 112 so that the first flow path 112 can be positioned as close as possible to the front end portion of the nozzle base 110 and thus the area which can be cleaned by using the nozzle 1 can be increased.

As the distance from the front end portion of the nozzle base 110 to the first flow path 112 increases, the area in which the suction force does not apply in front of the first flow path 112 during the cleaning process increases, and thus the area where the cleaning is not performed is increased.

On the other hand, according to the present embodiment, the distance from the front end portion of the nozzle base 110 to the first flow path 112 can be minimized, and thus the cleanable area can be increased.

In addition, by disposing the first roller 124 and the second roller 126 behind the first flow path 112, the length of the first flow path 112 in the lateral direction can be maximized.

In other words, the distance between both end portions of the first flow path 112 and both end portions of the nozzle base 110 can be minimized.

In the present embodiment, the first roller 124 may be positioned in a space between the first flow path 112 and the first mop 402. The second roller 126 may be positioned in a space between the first flow path 112 and the second mop 404.

The first roller 124 and the second roller 126 may be rotatably connected to a shaft 125, respectively. The shaft 125 may be fixed to the lower side of the nozzle base 110 in a state of being disposed so as to extend in the lateral direction.

The distance between the shaft 125 and the front end portion of the nozzle base 110 is longer than the distance between the front end portion of the nozzle base 110 and each of the mops 402 and 404 (or a rotation plate described later).

At least a portion of each of the rotation cleaning units 40 and 41 (mop and/or rotation plate) can be positioned between the shaft 125 of the first roller 124 and the shaft 125 of the second roller 126.

According to this disposition, the rotation cleaning units 40 and 41 can be positioned as close as possible to the first flow path 112, and the area to be cleaned by the rotation cleaning units 40 and 41 of the floor on which the nozzles 1 are positioned can be increased, and thus the floor cleaning performance can be improved.

The plurality of rollers are not limited, but the nozzle 1 can be supported at three points. In other words, the plurality of rollers may further include a third roller **129*a* provided on the extension portion 129 of the nozzle base 110**.

The third roller **129*a* may be positioned behind the mop 402, 404 to prevent interference with the mop 402, 404**.

Meanwhile, the nozzle main body 10 may further include a water tank 200 to supply water to the mops 402 and 404.

The water tank 200 may be detachably connected to the nozzle housing 100. The water in the water tank 200 can be supplied to each of the mops 402 and 404 in a state where the water tank 200 is mounted on the nozzle housing 100.

The nozzle main body 10 may further include an operating unit 300 that operates to separate the nozzle main body 10 in a state where the water tank 200 is mounted on the nozzle housing 100.

The operating unit 300 may be provided in the nozzle housing 100 as an example. The nozzle housing 100 may be provided with a first coupling unit 310 for coupling with the water tank 200 and the water tank **200*a* may be provided with a second coupling unit 254 for coupling with the first coupling unit 310**.

The operating unit 300 may be disposed so as to be capable of vertically moving in the nozzle housing 100. The first coupling unit 310 can be moved under the operation force of the operating unit 300 at the lower side of the operating unit 300.

For example, the first coupling unit 310 may move in the front and rear direction. For this purpose, the operating unit 300 and the first coupling unit 310 may include inclined surfaces contacting each other.

When the operating unit 300 is lowered by the inclined surfaces, the first coupling unit 310 can move horizontally (for example, movement in the front and rear direction).

The first coupling unit 310 includes a hook 312 for engaging with the second coupling unit 254 and the second coupling unit 254 includes a groove 256 for inserting the hook 312.

The first coupling unit 310 may be resiliently supported by the elastic member 314 so as to maintain a state where the first coupling unit 310 is coupled to the second coupling unit 254.

Therefore, when the hook 312 is in a state of being inserted into the groove 256 by the elastic member 314 and the operating unit 300 is pressed downward, the hook 312 is separated from the groove 256. The water tank 200 can be separated from the nozzle housing 100 in a state where the hook 312 is removed from the groove 256.

In the present embodiment, the operating unit 300 may be positioned directly above the second flow path 114, for example. For example, the operating unit 300 may be disposed to overlap the centerline A2 of the second flow path 114 in the vertical direction.

Meanwhile, the nozzle main body 10 may further include an adjusting unit 180 for adjusting the amount of water discharged from the water tank 200. For example, the adjusting unit 180 may be positioned on the rear side of the nozzle main body 10.

The adjusting unit 180 can be operated by a user and the adjusting unit 180 can prevent the water from being discharged from the water tank 200 or the water from being discharged.

Alternatively, the amount of water discharged from the water tank 200 can be adjusted by the adjusting unit 180. For example, when the adjusting unit 180 is operated, water is discharged from the water tank 200 by a first amount per unit time, or water is discharged by a second amount greater than the first amount per unit time.

The adjusting unit 180 may be pivotally mounted to the nozzle main body 10 in a lateral direction or may be pivoted in a vertical direction.

For example, in a state where the adjusting unit 180 is in the neutral position as shown in FIG. 4, the amount of water discharged is 0, and when the left side of the adjusting unit 180 is pushed to pivot the adjusting unit 180 to the left, water may be discharged from the water tank 200 by a first amount per unit time.

When the adjustment unit 180 is pushed to the right by pushing the right side of the adjustment unit 180, the second amount of water may be discharged from the water tank 200 per unit time. The configuration for detecting the operation of the adjusting unit 180 will be described later with reference to the drawings.

Figure 6:
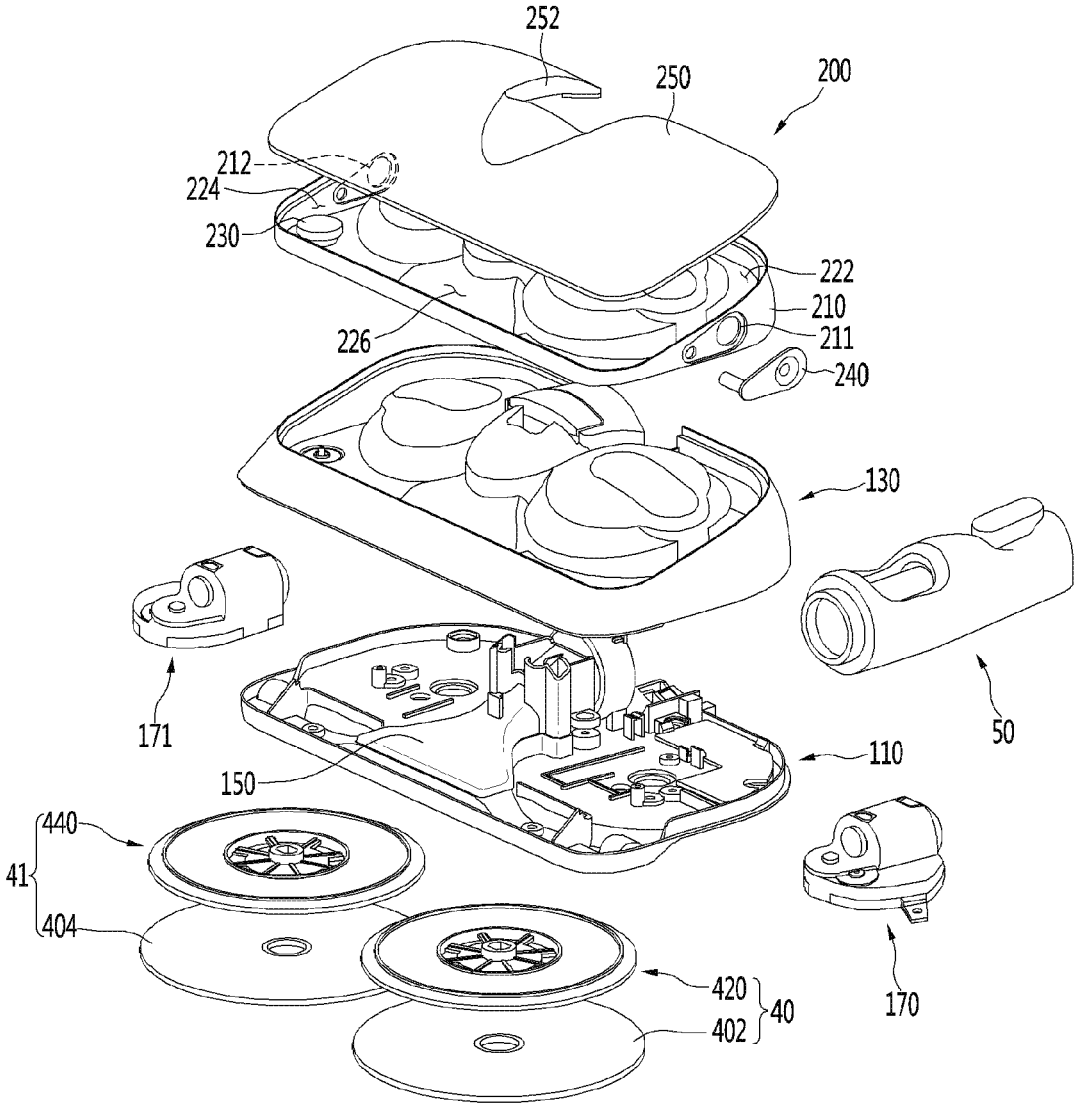
FIG. 6 and FIG. 7 are exploded perspective views illustrating a nozzle according to an embodiment of the present invention.
Figure 7:
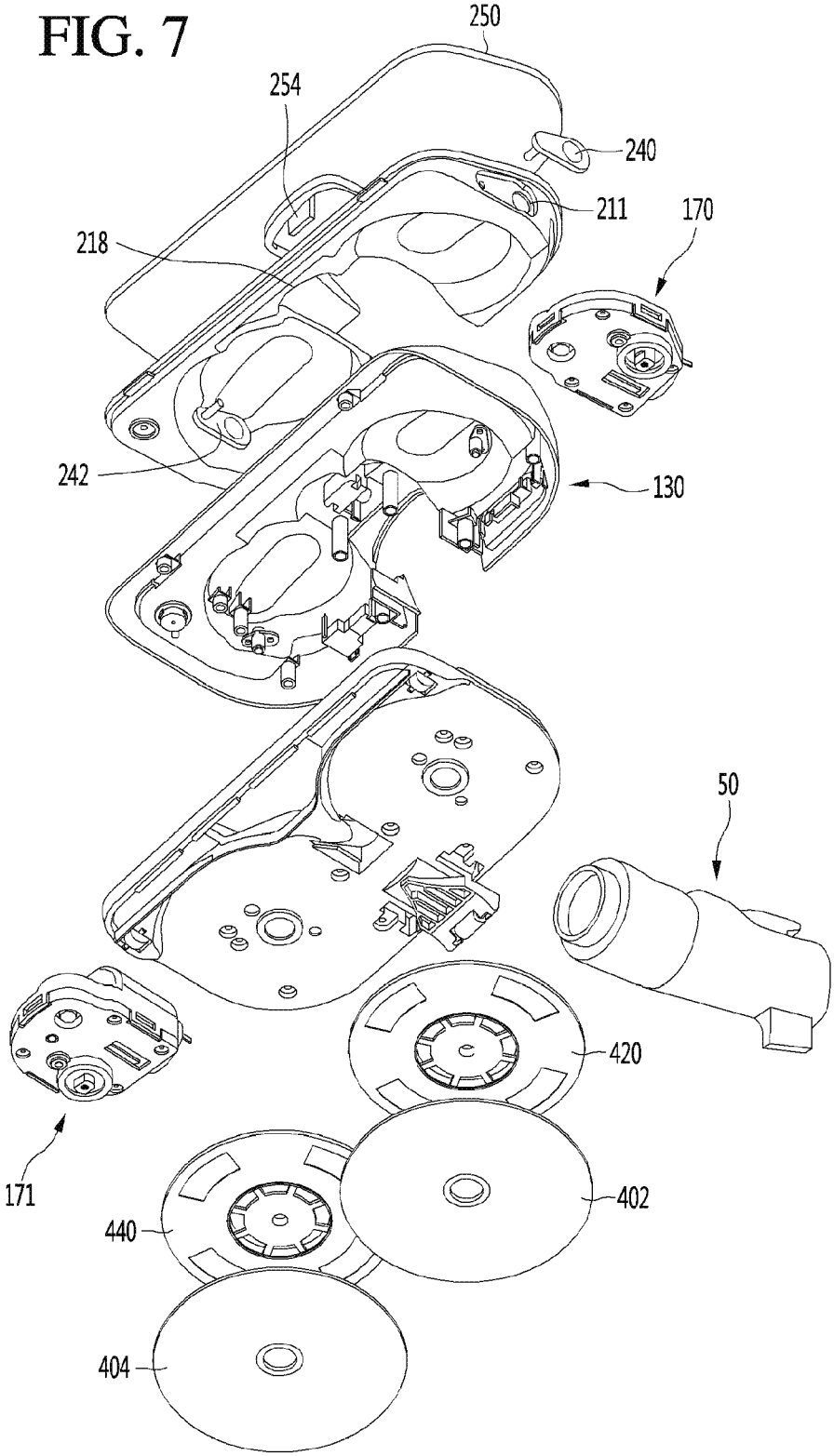
Figure 8:
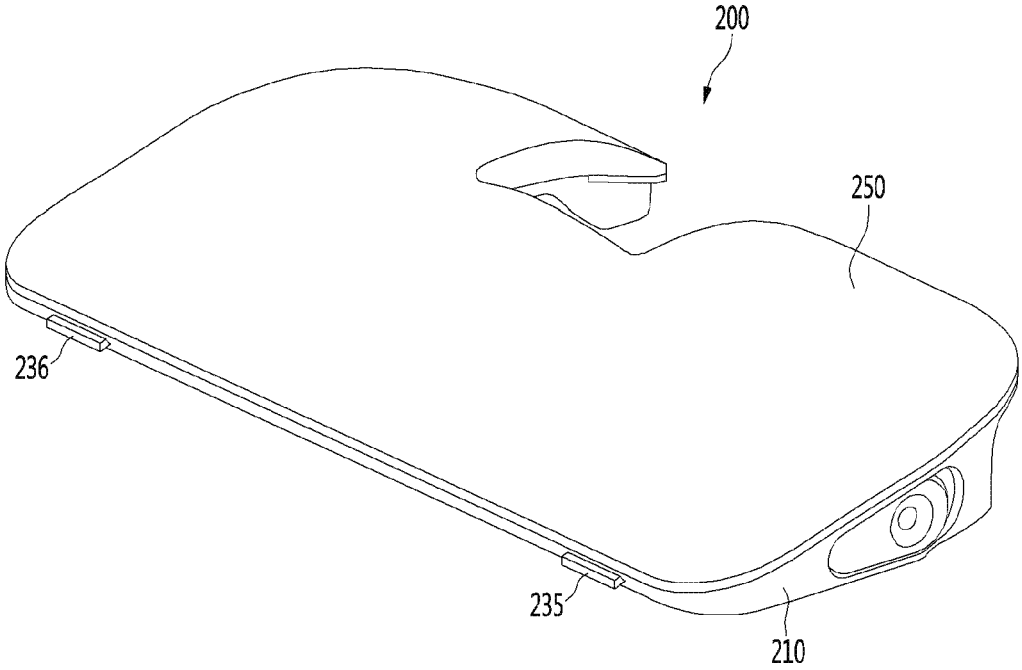
FIG. 8 and FIG. 9 are perspective views illustrating a water tank according to an embodiment of the present invention.
Figure 9:
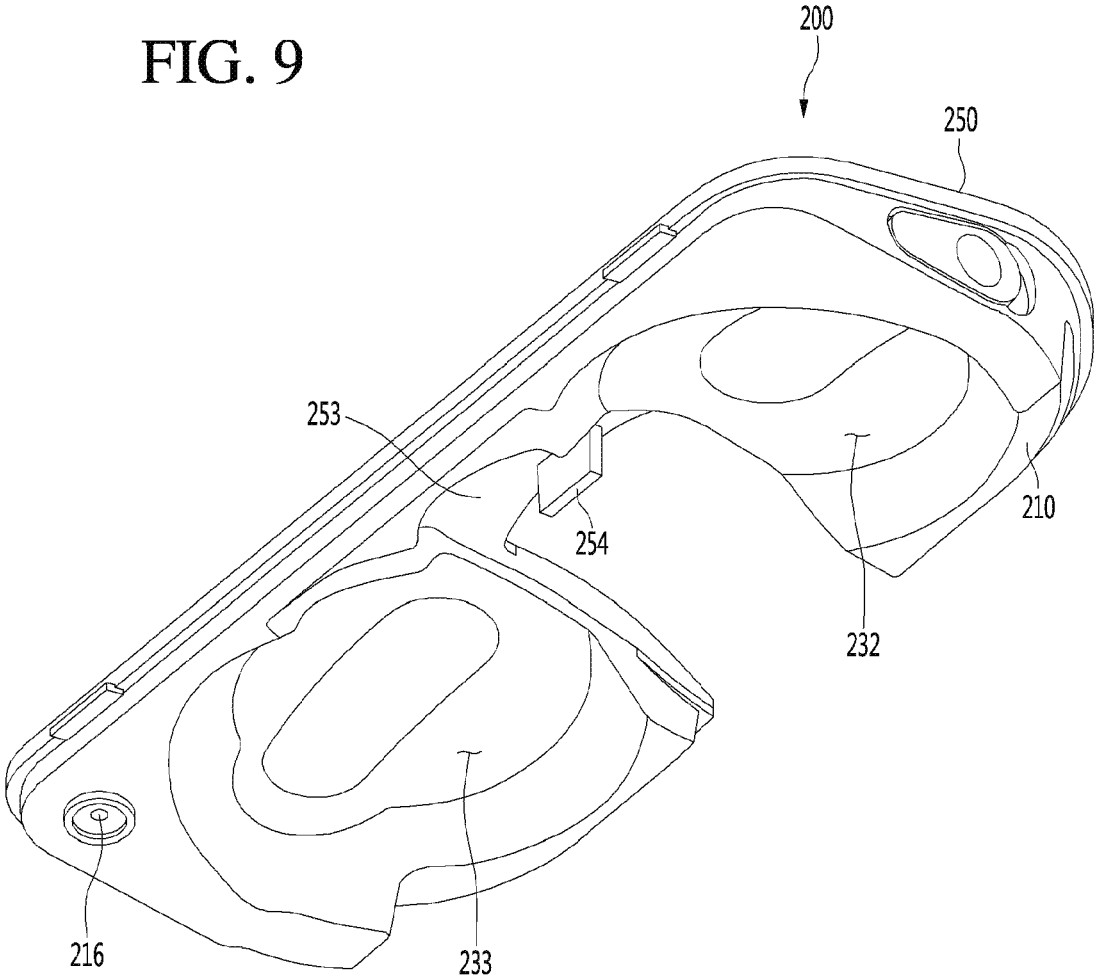

FIG. 6 and FIG. 7 are exploded perspective views of a nozzle according to an embodiment of the present invention, and FIG. 8 and FIG. 9 are perspective views of a water tank according to an embodiment of the present invention.

FIG. 3 and FIG. 6 to FIG. 9, the nozzle main body 10 may further include a plurality of driving devices 170 and 171 for individually driving the respective rotation cleaning units 40 and 41.

The plurality of driving devices 170 and 171 may include a first driving device 170 for driving the first rotation cleaning unit 40 and a second driving device 171 for driving the second rotation cleaning unit 41.

Since each of the driving devices 170 and 171 operates individually, even if some of the driving devices 170 and 171 fail, there is an advantage that some of the rotation cleaning devices can be rotated by another driving device.

The first driving device 170 and the second driving device 171 may be spaced apart from each other in the lateral direction in the nozzle main body 10.

The driving devices 170 and 171 may be positioned behind the first flow path 112.

For example, at least a portion of the second flow path 114 may be positioned between the first driving device 170 and the second driving device 171. Therefore, even if the plurality of driving devices 170 and 171 are provided, the second flow path 114 is not affected, and thus the length of the second flow path 114 can be minimized.

According to the present embodiment, since the first driving device 170 and the second driving device 171 are disposed on both sides of the second flow pathway 114, the weight of the nozzle 1 can be uniformly distributed to the left and right so that it is possible to prevent the center of gravity of the nozzle 1 from being biased toward any one of the nozzles 1.

The plurality of driving devices 170 and 171 may be disposed in the nozzle main body 10. For example, the plurality of driving devices 170 and 171 may be seated on the upper side of the nozzle base 110 and covered with the nozzle cover 130. In other words, the plurality of driving devices 170 and 171 may be positioned between the nozzle base 110 and the nozzle cover 130.

Each of the rotation cleaning units 40 and 41 may further include rotation plates 420 and 440 which are rotated by receiving power from each of the driving devices 170 and 171.

The rotation plates 420 and 440 may include a first rotation plate 420 which is connected to the first driving device 170 and to which the first mop 402 is attached and a second rotation plate 420 which is connected to the second driving device 171 and a second rotation plate 440 to which the second mop 404 is attached.

The rotation plates 420 and 440 may be formed in a disc shape, and the mops 402 and 404 may be attached to the bottom surface of the rotation plates 420 and 440.

The rotation plates 420 and 440 may be connected to each of the driving devices 170 and 171 on the lower side of the nozzle base 110. In other words, the rotation plates 420 and 440 may be connected to the driving devices 170 and 171 at the outside of the nozzle housing 100.

<Water Tank>

The water tank 200 may be mounted on the upper side of the nozzle housing 100. For example, the water tank 200 may be seated on the nozzle cover 130. The water tank 200 can form a portion of an outer appearance of the nozzle main body 10 in a state where the water tank 200 is seated on the upper side of the nozzle cover 130. For example, the water tank 200 may form a portion of an outer appearance of an upper surface of the nozzle main body 10.

The water tank 200 may include a first body 210, and a second body 250 coupled to the first body 210 and defining a chamber in which water is stored together with the first body 210.

The chamber may include a first chamber 222 positioned above the first driving device 170, a second chamber 224 positioned above the second driving device 171, and a connection chamber 226 communicating the first chamber 222 with the second chamber 224 and positioned above the second flow path 114.

In the present invention, the volume of the connection chamber 226 may be formed to be smaller than the volume of the first chamber 222 and the second chamber 24 so that the amount of water to be stored is increased while minimizing the height of the nozzle 1 by the water tank 200.

The water tank 200 may be formed so that the front height is low and the rear height is high. The upper surface of the water tank 200 may be inclined upward or rounded from the front side to the back side.

For example, the connection chamber 226 may connect the first chamber 222 and the second chamber 224 disposed on both sides in the front portion of the water tank 200. In other words, the connection chamber 226 may be positioned in the front portion of the water tank 200.

The water tank 200 may include a first inlet 211 for introducing water into the first chamber 222 and a second inlet 212 for introducing water into the second chamber 224.

The first inlet 211 may be covered by a first inlet cover 240 and the second inlet 212 may be covered by a second inlet cover 242. For example, each of the inlet covers 242 and 240 may be formed of a rubber material.

Each of the inlets 211 and 212 may be formed on both side surfaces of the first body 210, for example.

The height of both side surfaces of the first body 210 may be the lowest at the front end portion and may become higher toward the rear side.

So as to ensure the size of each of the inlets 211 and 212, each of the inlets 211 and 212 may be positioned closer to the rear end portion than the front end portion at both side surfaces of the first body 210.

The first body 210 may include a first slot 218 for preventing interference with the operating unit 300 and the coupling units 310 and 254. The first slot 218 may be formed such that the center rear end portion of the first body 210 is depressed forward.

In addition, the second body 230 may include a second slot 252 for preventing interference with the operating unit 300. The second slot 252 may be formed such that the center rear end portion of the second body 230 is depressed forward.

The second body 230 may further include a slot cover 253 covering a portion of the first slot 218 of the first body 210 in a state of being coupled to the first body 210. In other words, the front and rear length of the second slot 252 is shorter than the front and rear length of the first slot 218.

The second coupling unit 254 may extend downward from the slot cover 253. Accordingly, the second coupling unit 254 may be positioned within the space formed by the first slot 218.

The water tank 200 may further include a coupling rib 235 and 236 for coupling with the nozzle cover 130 before the second coupling unit 254 of the water tank 200 is coupled with the first coupling unit 310.

The coupling rib 235 and 236 also performs a role which guides the coupling position of the water tank 200 in the nozzle cover 130 before the second coupling unit 254 of the water tank 200 is coupled with the first coupling unit 310.

For example, a plurality of coupling ribs 235 and 236 protrude from the first body 110 and may be disposed so as to be spaced apart in the left and rear horizontal direction.

Though not limited, the plurality of coupling ribs 235 and 236 may protrude forward from the front surface of the first body 210 and may be spaced apart from each other in the lateral direction.

Each of the driving devices 170 and 171 is provided in the nozzle housing 100 so that a portion of the nozzle housing 100 protrudes upward at both sides of the second flow path 114 by each of the driving devices 170 and 171.

The water tank 200 may form a pair of receiving spaces 232 and 233 so as to prevent the water tank 200 from interfering with a portion protruding from the nozzle housing 100. The pair of receiving spaces 232 and 233 may be formed as a portion of the first body 210 is recessed upward. The pair of receiving spaces 232 and 233 may be divided into right and left by the first slot 218.

The water tank 200 may further include a discharge port 216 through which water is discharged.

The discharge port 216 may be formed on the lower surface of the first body 210, for example.

The discharge port 216 may be opened or closed by a valve 230. The valve 230 may be disposed in the water tank 200. The valve 230 can be operated by an external force, and the valve 230 maintains a state where the discharge port 216 is closed as long as no external force is applied. Therefore, water can be prevented from being discharged from the water tank 200 through the discharge port 216 in a state where the water tank 200 is separated from the nozzle main body 10.

In the present embodiment, the water tank 200 may include a single discharge port 216. The discharge port 216 may be positioned below one of the first chamber 222 and the second chamber 224. In other words, the discharge port 116 can be positioned close to any one of the pair of receiving spaces 232 and 233.

The reason why the water tank 200 is provided with the single discharge port 216 is to reduce the number of parts that may cause water leakage.

In other words, since there is a component (control board, driving motor, or the like) in the nozzle 1 which receives power and operates, the contact of the component with water must be completely blocked. So as to block the contact between the component and the water, leakage at the portion through which water is discharged at the water tank 200 is basically minimized.

As the number of the discharge ports 216 in the water tank 200 is increased, a structure for preventing water leakage is additionally required so that the structure thereof is complicated and there is a possibility that water leakage cannot be completely prevented even if there is a structure for preventing water leakage.

In addition, as the number of discharge ports 216 in the water tank 200 is increased, the number of the valves 230 for opening and closing the discharge port 216 is also increased. This means that the number of components is increased and the volume of the chamber for water storage in the water tank 200 is reduced by the valve 230.

Since the height of the rear side of the water tank 200 is higher than that of the front side of the water tank 200, the discharge port 216 is positioned close to the front end portion of the first body 210 so that the water in the water tank 200 can be smoothly discharged.

<Nozzle Cover>

Figure 10:
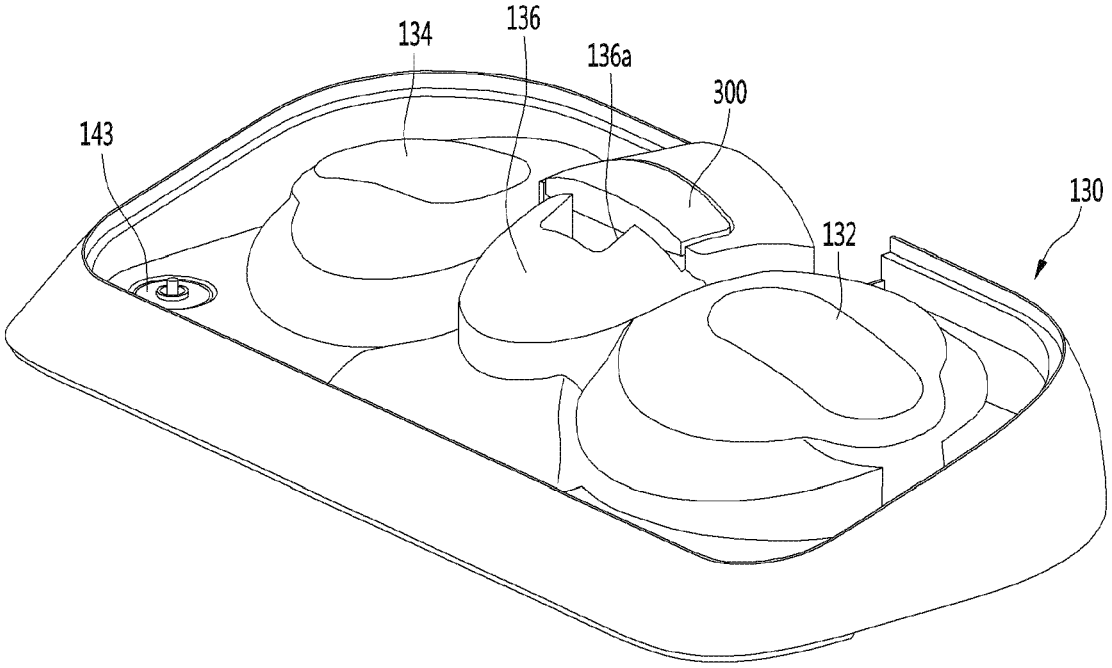
FIG. 10 is a perspective view illustrating a nozzle cover according to an embodiment of the present invention as viewed from above.
Figure 11:
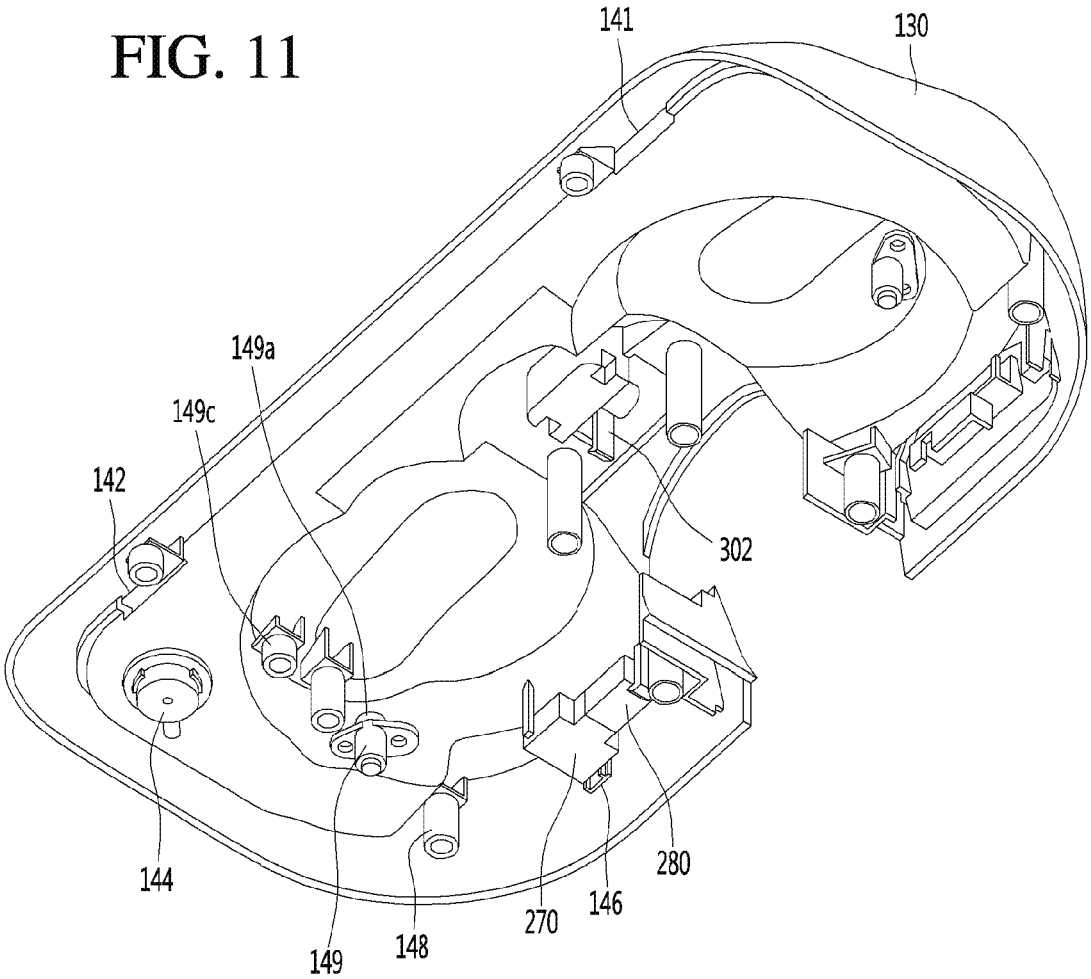
FIG. 11 is a perspective view illustrating a nozzle cover according to an embodiment of the present invention as viewed from below.

FIG. 10 is a perspective view illustrating a nozzle cover according to an embodiment of the present invention as viewed from above, and FIG. 11 is a perspective view illustrating a nozzle cover according to an embodiment of the present invention as viewed from below.

Referring to FIG. 6, FIG. 10, and FIG. 11, the nozzle cover 130 may include driving unit covers 132 and 134 that cover the upper side of each of the driving units 170 and 171.

Each of the driving unit covers 132 and 134 is a portion which protrudes upward from the nozzle cover 130. Each of the driving unit covers 132 and 134 can surround the upper side of the driving devices 170 and 171 without interfering with each of the driving devices 170 and 171 installed in the nozzle base 110. In other words, the driving unit covers 132 and 134 are spaced apart from each other in the lateral direction in the nozzle cover 130.

When the water tank 200 is seated on the nozzle cover 130, each of the driving unit cover 132 and 134 is received in each of the receiving spaces 232 and 233 of the water tank 200, and thus interference between the components is prevented.

In addition, in the water tank 200, the first chamber 222 and the second chamber 224 may be disposed so as to surround the periphery of each of the respective driving unit covers 132 and 134.

Thus, according to the present embodiment, the volumes of the first chamber 222 and the second chamber 224 can be increased.

The first body 210 of the water tank 200 may be seated at a lower portion of the nozzle cover 130 than the driving unit cover 132 and 134.

At least a portion of the bottom of the water tank 200 may be positioned lower than the axis of the driving motor (see A3 and A4 in FIG. 21) to be described later so that the height increase by the water tank 200 is minimized. For example, the bottoms of the first chamber 122 and the second chamber 124 may be positioned lower than the axis of the driving motor (see A3 and A4 in FIG. 21), which will be described later.

The nozzle cover 130 may further include a flow path cover 136 covering the flow path forming portion 150. The flow path cover 136 may be disposed between the driving unit covers 132 and 134 and may be disposed at a position corresponding to the first slot 218 of the water tank 200.

The flow path cover 136 can support the operating unit 300. The operating unit 300 may include a coupling hook 302 for coupling to the flow path cover 136. The operating unit 300 may be coupled to the flow path cover 136 from above the flow path cover 136.

It is possible to prevent the operating unit 300 from being separated upward from the flow path cover 136 in a state where the coupling hook 302 is coupled to the flow path cover 136.

The flow path cover 136 may have an opening 136*a* into which the second coupling unit 154 can be inserted. The first coupling unit 310 may be coupled to the second coupling unit 254 while the second coupling unit 254 of the water tank 200 is inserted into the opening 136*a*.

The flow path cover 136 may be positioned in the first slot 218 of the first body 210 and the second slot 252 of the second body 250.

In the present embodiment, so as to increase the water storage capacity of the water tank 200, a portion of the water tank 200 may be positioned on both sides of the flow path cover 136. Therefore, the water storage capacity of the water tank 200 can be increased while preventing the water tank 200 from interfering with the second flow path 114.

In addition, the highest point of the water tank 200 may be equal to or lower than the highest point of the flow path cover 136 so that the height of the nozzle 1 by the water tank 200 is prevented from increasing.

In addition, so as to prevent the water tank 200 from colliding with structures around the nozzle 1 during the movement of the nozzle 1, the entire water tank 200 can be disposed to overlap with the nozzle housing 100 in the vertical direction. In other words, the water tank 200 may not protrude in the lateral and the front and rear directions of the nozzle housing 100.

The nozzle cover 130 may further include rib insertion holes 141 and 142 into which the coupling ribs 235 and 236 provided in the water tank 200 are inserted. The rib insertion holes 141 and 142 may be spaced apart from the nozzle cover 130 in the lateral horizontal direction.

Accordingly, the center or rear portion of the water tank 200 is moved downward in a state where the coupling ribs 235 and 236 are inserted into the rib insertion holes 141 and 142, and thus the second coupling unit 254 may be coupled to the first coupling portion 310.

The nozzle cover 130 may be provided with a valve operating unit 144 for operating the valve 230 in the water tank 200. The valve operating unit 144 may be coupled to the nozzle cover 130.

The water discharged from the water tank 200 can flow through the valve operating unit 144.

The valve operating unit 144 may be coupled to the lower side of the nozzle cover 130, and a portion of the valve operating unit 144 may protrude upward through the nozzle cover 130.

The valve operating unit 144 protruding upward is introduced in the water tank 200 through the discharge port 216 of the water tank 200 when the water tank 200 is mounted on the nozzle housing 100. In other words, the valve operating unit 144 may be disposed at a position facing the discharge port 216 of the water tank 200.

The valve operating unit 144 will be described later with reference to the drawings.

The nozzle cover 130 may be provided with a sealer 143 for preventing water discharged from the water tank 200 from leaking from the vicinity of the valve operating unit 144. The sealer 143 may be formed of rubber material, for example, and may be coupled to the nozzle cover 130 from above the nozzle cover 130. The discharge port 216 may be in contact with the sealer 143.

The nozzle cover 130 may be provided with a water pump 270 for controlling water discharge from the water tank 200. The water pump 270 may be connected to a pump motor 280.

A pump installation rib 146 for installing the water pump 270 may be provided on the lower side of the nozzle cover 130. The water pump 270 and the pump motor 280 are installed in the nozzle cover 130 so that the pump motor 280 is prevented from contacting the water even if the water drops into the nozzle base 110.

The water pump 270 is a pump that operates so as to communicate the inlet and the outlet by expanding or contracting the valve body therein while being operated, and the pump can be realized by a well-known structure, and thus a detailed description thereof will be omitted.

The valve body in the water pump 270 can be driven by the pump motor 280. Therefore, according to the present embodiment, water in the water tank 200 can be continuously and stably supplied to the rotation cleaning units 40 and 41 while the pump motor 280 is operating.

The operation of the pump motor 280 can be adjusted by operating the above-described adjusting unit 180. For example, the adjusting unit 180 may select the on/off state of the pump motor 280.

Alternatively, the output (or rotational speed) of the pump motor 280 may be adjusted by the adjusting unit 180.

The nozzle cover 130 may further include at least one fastening boss 148 to be coupled with the nozzle base 110.

In addition, the nozzle cover 130 may be provided with a spray nozzle 149 for spraying water to the rotation cleaning units 40 and 41 to be described later. For example, a pair of spray nozzles 149 may be installed on the nozzle cover 130 in a state where the spray nozzles 149 are spaced apart from each other in the lateral direction.

The nozzle cover 130 may be provided with a nozzle installation boss 149*c* for mounting the spray nozzle 149. For example, the spray nozzle 149 may be fastened to the nozzle installation boss 149*c* by a screw.

The spray nozzle 149 may include a connection unit 149*a* for connecting a branch tube to be described later.

<Nozzle Base>

Figure 12:
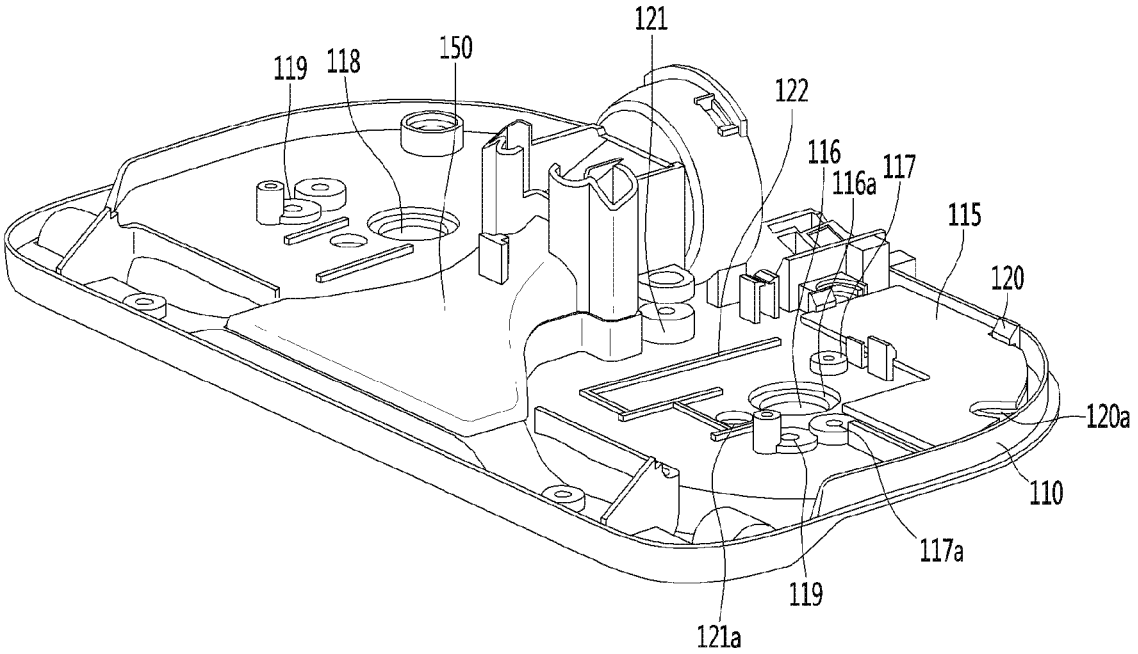
FIG. 12 is a view illustrating a state where a flow path forming portion is coupled to a nozzle base according to an embodiment of the present invention.
Figure 13:
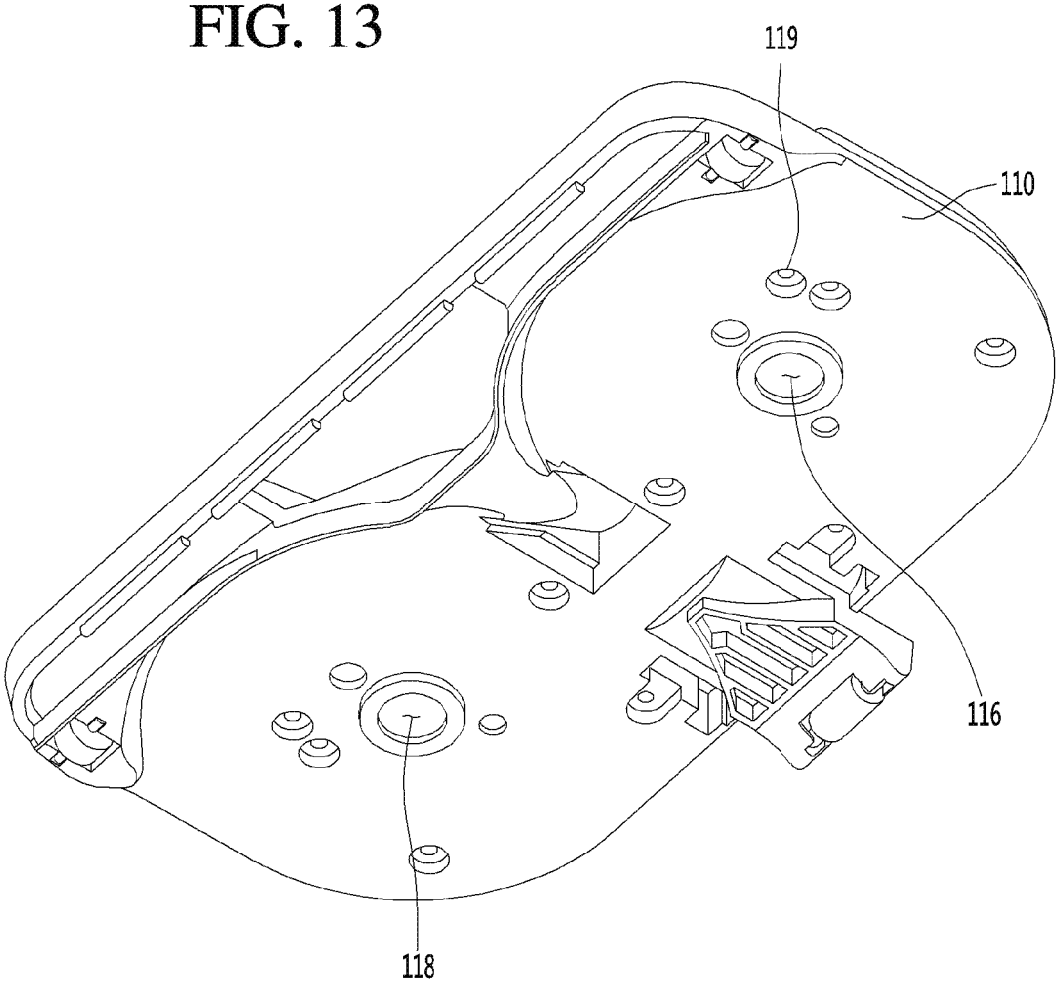
FIG. 13 is a view illustrating a nozzle base according to an embodiment of the present invention as viewed from below.

FIG. 12 is a view illustrating a state where a flow path forming portion is coupled to a nozzle base according to an embodiment of the present invention, and FIG. 13 is a view illustrating a nozzle base according to an embodiment of the present invention as viewed from below.

Referring to FIG. 6, FIG. 12, and FIG. 13, the nozzle base 110 may include a pair of shaft through-holes 116 and 118 through which a transmission shaft (to be described later) that is connected to each of the rotation plates 420 and 440 in each of the driving devices 170 and 171 passes.

The nozzle base 110 is provided with a seating groove 116*a* for seating a sleeve (to be described later) provided in each of the driving devices 170 and 171, and the shaft through-holes 116 and 118 may be formed in the seating groove 116*a*.

The seating groove 116*a* may be formed in a circular shape, as an example and may be recessed downward from the nozzle base 110. The shaft through-holes 116 and 118 may be formed in the bottom of the seating groove 116*a*.

In the process of moving the nozzle 1 or the operation of the driving devices 170 and 171 as the sleeves (to be described later) provided in the driving devices 170 and 171 are seated in the seating grooves 116*a*, the horizontal movement of the driving devices 170 and 171 can be restricted.

Each of the shaft through-holes 116 and 118 may be disposed on both sides of the flow path forming portion 150 in a state where the flow path forming portion 150 is coupled to the nozzle base 110.

The nozzle base 110 may be provided with a board installation portion 120 for installing a control board 115 for controlling each of the driving devices 170 and 171. For example, the board installation portion 120 may be formed as a hook shape extending upward from the nozzle base 110.

The hooks of the board installation portion 120 are hooked on the upper surface of the control board 115 to restrict upward movement of the control board 115.

The control board 115 may be disposed in a horizontal state. The control board 115 may be installed so as to be spaced apart from the bottom of the nozzle base 110.

Therefore, even if water falls to the bottom of the nozzle base 110, water can be prevented from contacting the control board 115.

The nozzle base 110 may be provided with a support protrusion 120*a* for supporting the control board 115 away from the bottom.

The board installation portion 120 may be positioned at one side of the flow path forming portion 150 in the nozzle base 110, although not limited thereto. For example, the control board 115 may be disposed at a position adjacent to the adjusting unit 180.

Therefore, a switch (to be described later) installed on the control board 115 can sense the operation of the adjusting unit 180.

In the present embodiment, the control board 115 may be positioned on the opposite side of the valve operating unit 144 with respect to the second flow path 114. Therefore, even if leakage occurs in the valve operating unit 144, water can be prevented from flowing to a side of the control board 115.

The nozzle base 110 may further include supporting ribs 122 for supporting the lower sides of each of the driving devices 170 and 171 and fastening bosses 117 and 117*a* for fastening each of the driving devices 170 and 171.

The supporting ribs 122 protrude from the nozzle base 110 and are bent at least once to separate each of the driving devices 170 and 171 from the bottom of the nozzle base 110. Alternatively, a plurality of spaced apart supporting ribs 122 may protrude from the nozzle base 110 to separate each of the driving devices 170 and 171 from the bottom of the nozzle base 110.

Even if water falls to the bottom of the nozzle base 110, the driving devices 170 and 171 are spaced apart from the bottom of the nozzle base 110 by the supporting ribs 122 so that it is possible to minimize the flow of water on the side of the drive device 170, 171.

In addition, the nozzle base 110 may further include a nozzle hole 119 through which each of the spray nozzles 149 passes.

A portion of the spray nozzle 149 coupled to the nozzle cover 130 may pass through the nozzle hole 119 when the nozzle cover 130 is coupled to the nozzle base 110.

In addition, the nozzle base 110 may further include an avoidance hole 121*a* for preventing interference with the structures of each of the driving devices 170 and 171, and a fastening boss 121 for fastening the flow path forming portion 150.

A portion of each of the driving devices 170 and 171 may be positioned in the avoidance hole 121*a* so that the supporting rib 122 may be positioned at the periphery of the avoidance hole 121*a* so as to minimize the flow of water to the avoidance hole 121*a*.

For example, the supporting rib 122 may be positioned in the avoidance hole 121*a* in the formed region.

<Installation Position of a Plurality of Switches>

Figure 14:
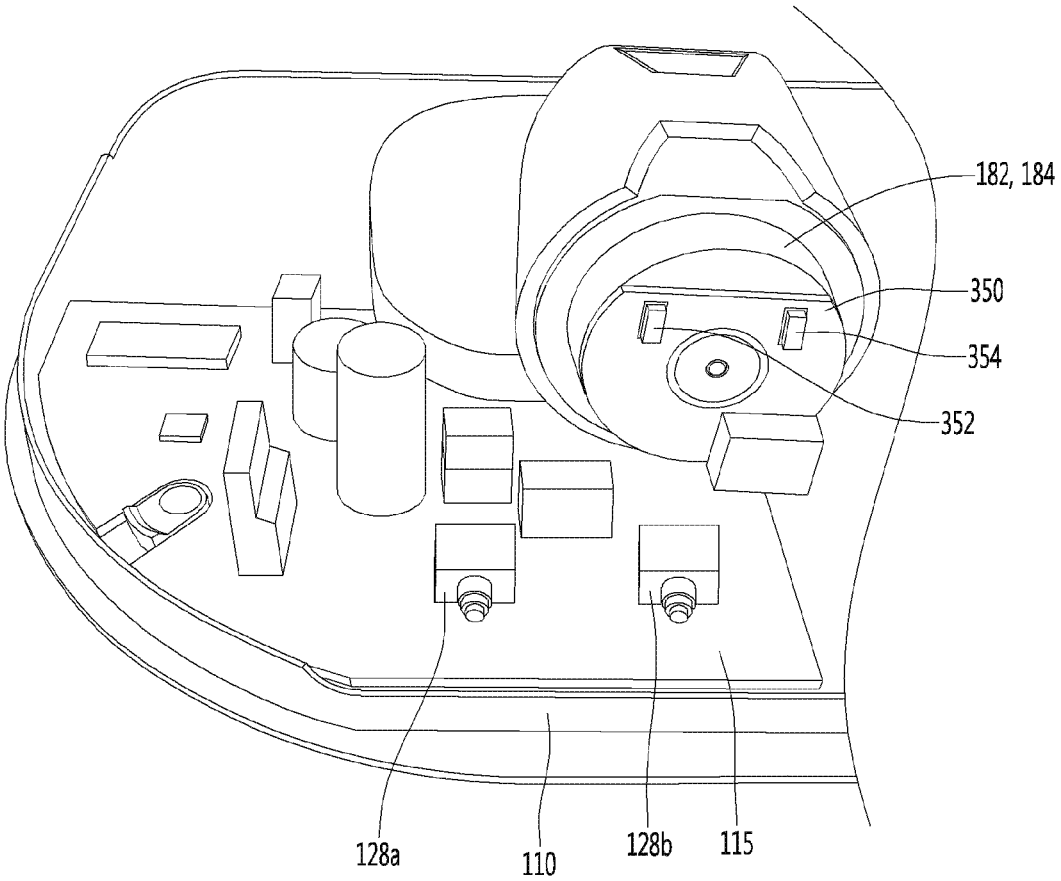
FIG. 14 is a view illustrating a plurality of switches installed on a control board according to an embodiment of the present invention.

FIG. 14 is a view illustrating a plurality of switches provided on a control board according to an embodiment of the present invention.

Referring to FIG. 4 and FIG. 14, the nozzle base 110 is provided with a control board 115 as described above. A plurality of switches 128*a* and 128*b* may be provided on the upper surface of the control board 115 to sense the operation of the adjusting unit 180.

The plurality of switches 128*a* and 128*b* may be installed in a state of being spaced apart in the lateral direction.

The plurality of switches 128*a* and 128*b* may include a first switch 128*a* for sensing a first position of the adjusting unit 180 and a second switch 128*b* for sensing a second position of the adjusting unit 180.

For example, when the adjusting unit 180 is pivoted to the left and moves to the first position, the adjusting unit 180 presses the contact of the first switch 128*a* to turn on the first switch 128*a*. In this case, the pump motor 280 operates as a first output, and water can be discharged by the first amount per unit time in the water tank 200.

When the adjusting unit 180 pivots to the right and moves to the second position, the adjusting unit 180 presses the contact of the second switch 128*b* so that the second switch 128*b* is turned on.

In this case, the pump motor 280 operates as a second output, which is larger than the first output, so that the water can be discharged by the second amount per unit time in the water tank 200.

When the adjusting unit 180 is positioned at a neutral position between the first position and the second position, the adjusting unit 180 does not press the contacts of the first switch 128*a* and the second switch 128*b* and the pump motor 280 is stopped.

<Driving Device>

Figure 15:
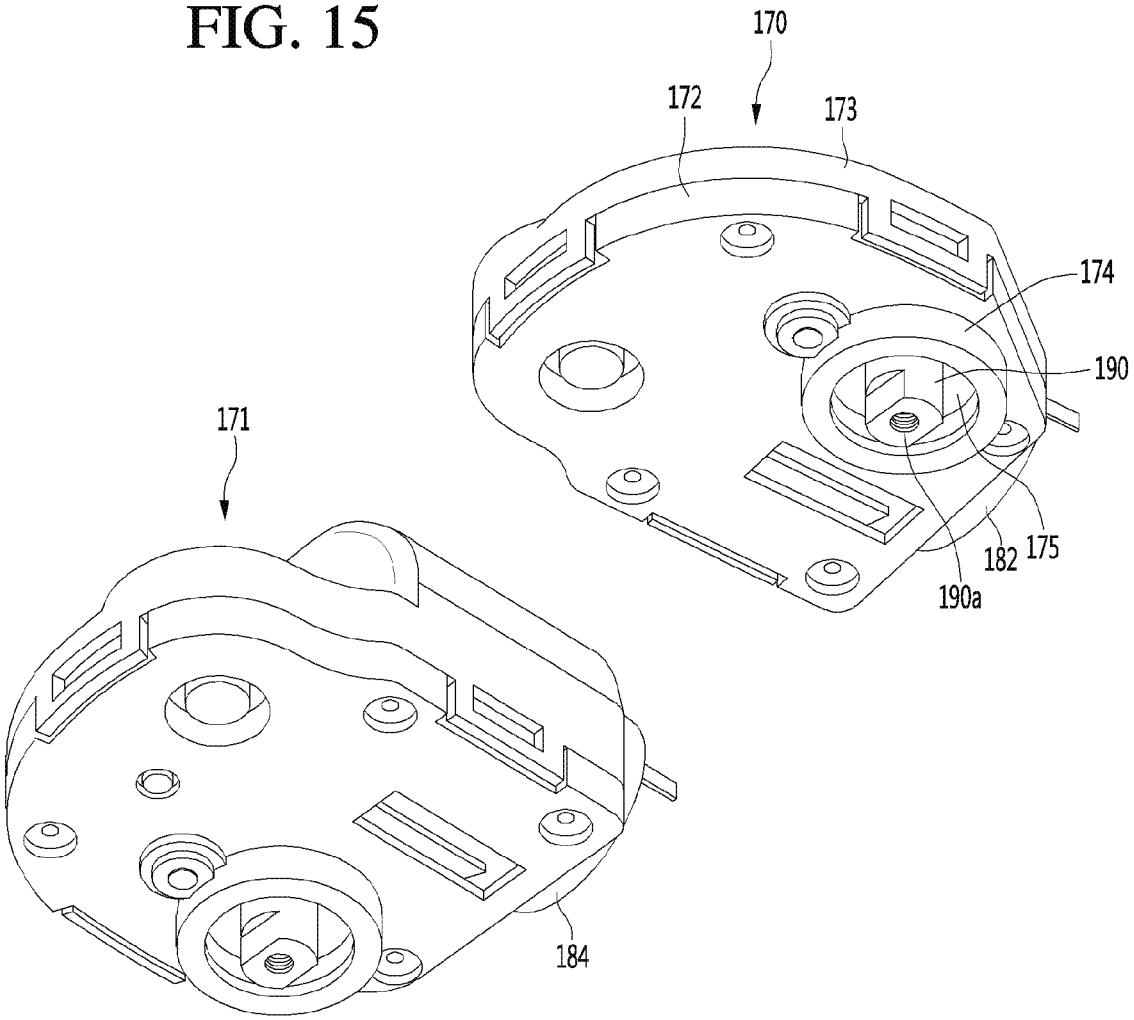
FIG. 15 is a view illustrating the first and second driving devices according to one embodiment of the present invention as viewed from below.
Figure 16:
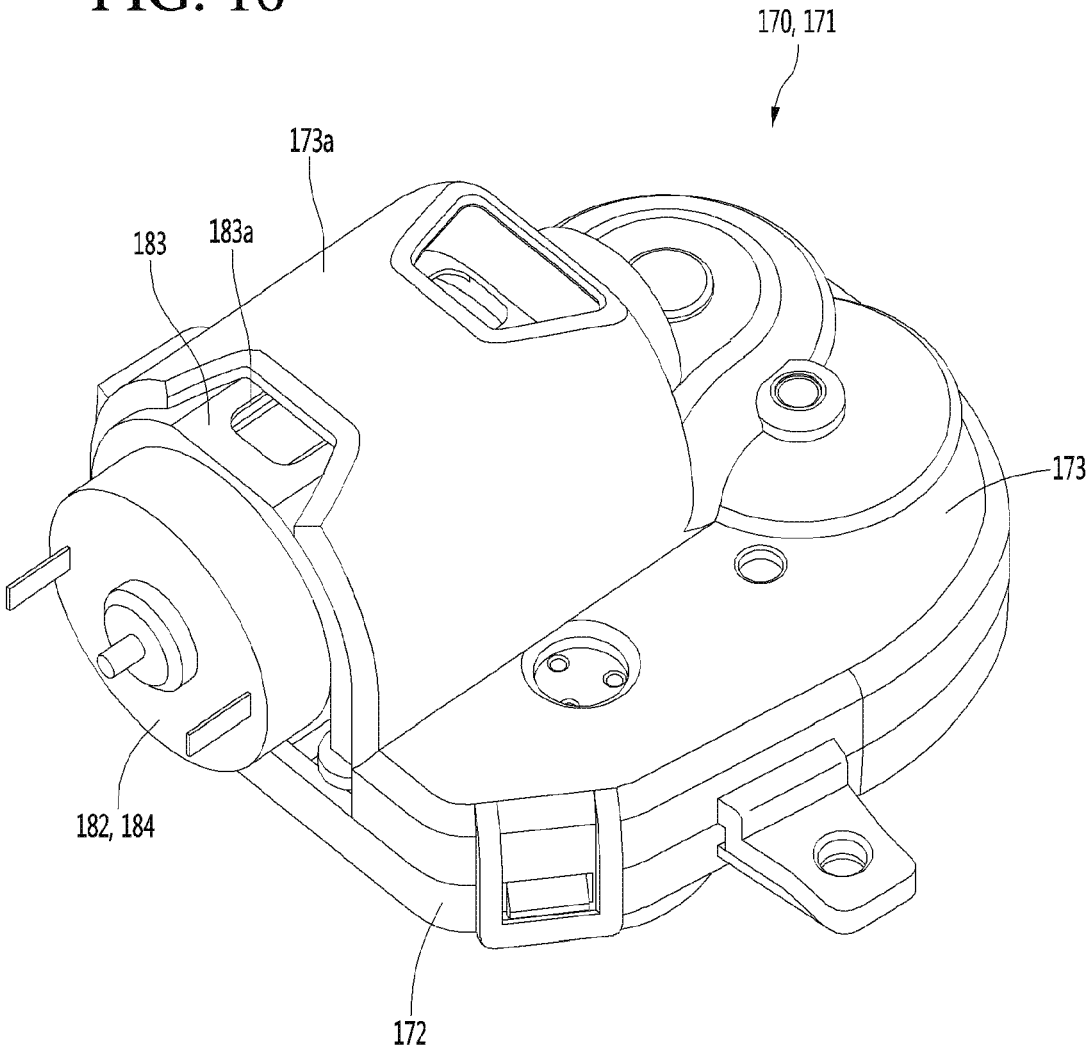
FIG. 16 is a view illustrating the first and second driving devices according to the embodiment of the present invention as viewed from above.
Figure 17:
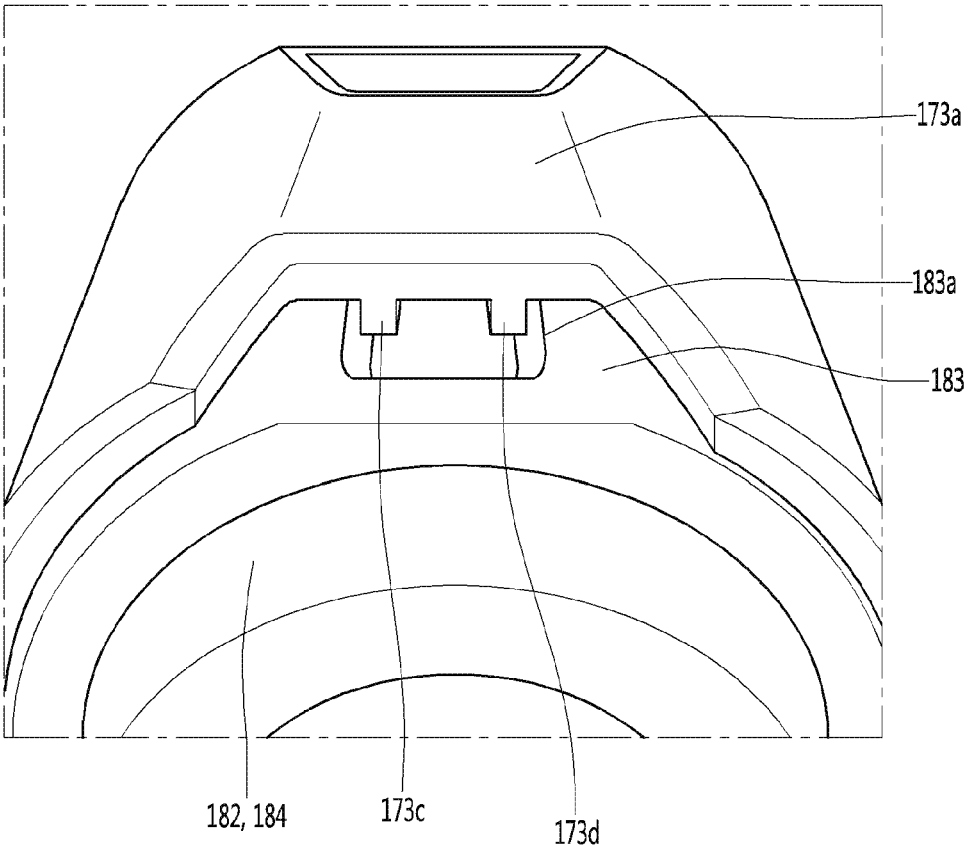
FIG. 17 is a view illustrating a structure for preventing rotation of the motor housing and the driving motor.
Figure 18:
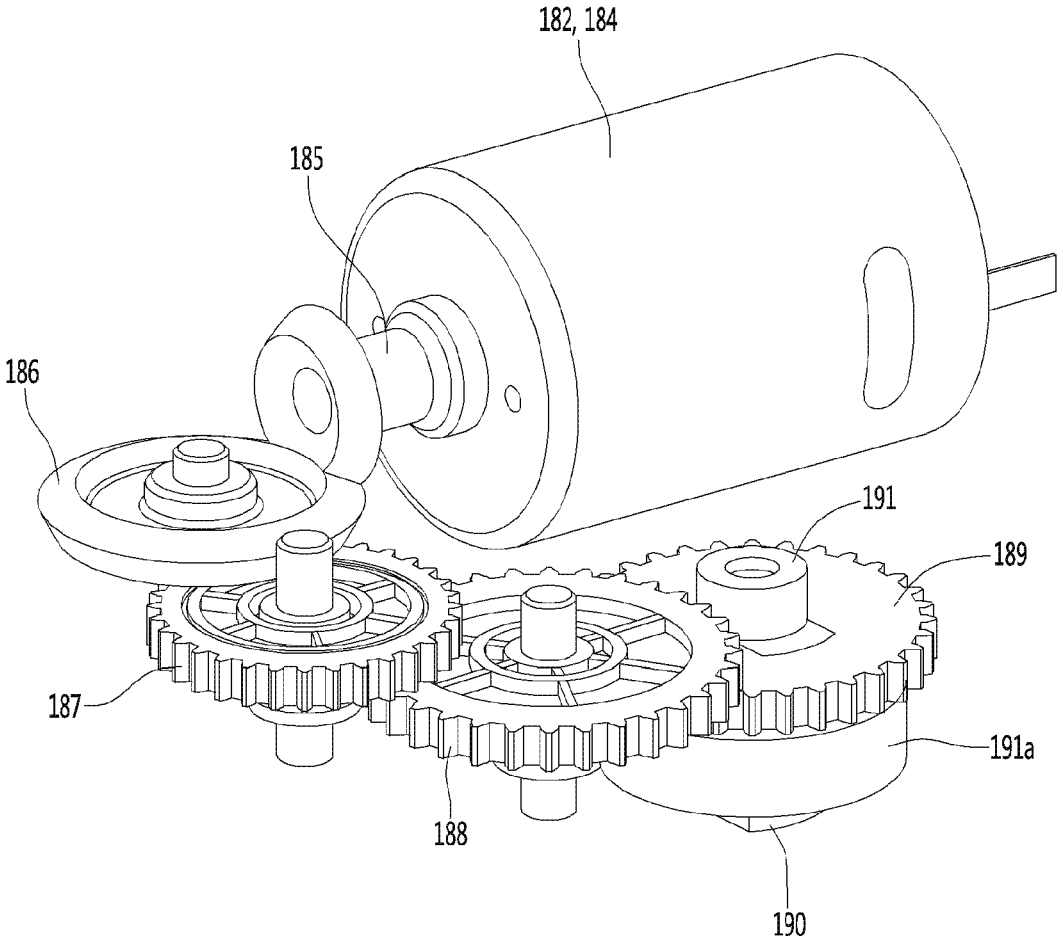
FIG. 18 is a view illustrating a state where a power transmission unit is coupled to a driving motor according to an embodiment of the present invention.

FIG. 15 is a view illustrating the first and second driving devices according to one embodiment of the present invention as viewed from below, FIG. 16 is a view illustrating the first and second driving devices according to the embodiment of the present invention as viewed from above, FIG. 17 is a view illustrating a structure for preventing rotation of the motor housing and the driving motor, and FIG. 18 is a view illustrating a state where a power transmission unit is coupled to a driving motor according to an embodiment of the present invention.

Referring to FIG. 14 to FIG. 18, the first driving device 170 and the second driving device 171 may be formed and disposed symmetrically in the lateral direction.

The first driving device 170 may include a first driving motor 182 and the second driving device 171 may include a second driving motor 184.

A motor PCB 350 for driving each of the driving motors may be connected to the driving motors 182 and 184. The motor PCB 350 may be connected to the control board 115 to receive a control signal. The motor PCB 350 may be connected to the driving motors 182 and 184 in a standing state and may be spaced apart from the nozzle base 110.

The motor PCB 350 may include a plurality of resistors 352 and 354 for improving Electro Magnetic Interference (EMI) performance of the driving motor.

For example, a pair of resistors 352 and 354 may be provided in the motor PCB 350.

One resistor of the pair of resistors 352 and 354 may be connected to the (+) terminal of the driving motor and the other resistor may be connected to the (−) terminal of the driving motor. Such a pair of resistors 352 and 354 can reduce the fluctuation of the output of the driving motor.

The pair of resistors 352 and 354 may be spaced laterally from the motor PCB 350, for example.

Each of the driving devices 170 and 171 may further include a motor housing. The driving motors 182 and 184 and a power transmission unit for transmitting power can be received in the motor housing.

The motor housing may include, for example, a first housing 172, and a second housing 173 coupled to the upper side of the first housing 172.

The axis of each of the driving motors 182 and 184 may extend in the horizontal direction in a state where each of the driving motors 182 and 184 is installed in the motor housing. If the driving devices are installed in the motor housing so that the axis of each of the driving motors 182 and 184 extends in the horizontal direction, the driving devices 170 and 171 can be compact.

The first housing 172 may have a shaft hole 175 through which the transmission shaft 190 for coupling with the rotation plates 420 and 440 of the power transmission unit passes. For example, a portion of the transmission shaft 190 may protrude downward through the lower side of the motor housing.

The horizontal section of the transmission shaft 190 may be formed in a non-circular shape such that relative rotation of the transmission shaft 190 is prevented in a state where the transmission shaft 190 is coupled with the rotation plates 420 and 440.

A sleeve 174 may be provided around the shaft hole 175 in the first housing 172. The sleeve 174 may protrude from the lower surfaces of the first housing 172.

The sleeve 174 may be formed in a ring shape, for example. Therefore, the sleeve 174 can be seated in the seating groove 116 in a circular shape.

The driving motors 182 and 184 may be seated on the first housing 172 and fixed to the first housing 172 by the motor fixing unit 183 in this state.

The driving motors 182 and 184 may be formed in a cylindrical shape and the driving motors 182 and 184 may be seated in the first housing 172 in a state where the axes of the driving motors 182 and 184 are horizontal (in a state where driving motors 182 and 184 are lying down).

The motor fixing unit 183 may be formed in an approximately semicircular shape in cross section and may cover the upper portion of the driving motors 182 and 184 seated on the first housing 172. The motor fixing unit 183 may be fixed to the first housing 172 by a fastening member such as a screw, as an example.

The second housing 173 may include a motor cover **173*a* covering a portion of the driving motors 182 and 184**.

The motor cover **173*a* may be rounded so as to surround the motor fixing unit 183 from the outside of the motor fixing unit 183**, for example.

For example, the motor cover **173*a* may be formed in a round shape such that a portion of the second housing 173** protrudes upward.

Rotation preventing ribs **173*c* and 173*d* are formed on the surface facing the motor fixing unit 183 from the motor cover 173*a* so as to prevent relative rotation between the motor cover 173*a* and the motor fixing unit 183 during the operation of the driving motors 182 and 184, and a rib receiving slot 183*a* in which the rotation preventing ribs 173*c* and 173*d* are received can be formed in the motor fixing unit 183**.

Though not limited, the width of the rotation preventing ribs **173*c* and 173*d* and the width of the rib receiving slot 183*a*** may be the same.

Alternatively, a plurality of rotation preventing ribs **173*c* and 173*d* may be spaced apart from the motor cover 173*a* in the circumferential direction of the driving motors 182 and 184, and a plurality of rotation preventing ribs 173*c* and 173*d* can be received in the rib receiving slot 183*a***.

At this time, the maximum width of the plurality of rotation preventing ribs **173*c* and 173*d* in the circumferential direction of the driving motors 182 and 184 may be equal to or slightly smaller than the width of the rib receiving slot 183*a***.

The power transmission unit may include a driving gear 185 connected to the shaft of each of the driving motors 182 and 184 and a plurality of transmission gears 186, 187, 188, and 189 for transmitting the rotational force of the driving gear 185.

The axis of the driving motors 182 and 184 (see A3 and A4 in FIG. 20) extends in the horizontal direction while the rotation centerline of the rotation plates 420 and 440 extends in the vertical direction. Therefore, the driving gear 185 may be a spiral bevel gear, for example.

The plurality of transmission gears 186, 187, 188, and 189 may include a first transmission gear 186 that engages with the driving gear 185. The first transmission gear 186 may have a rotation center extending in a vertical direction.

The first transmission gear 186 may include a spiral bevel gear so that the first transmission gear 186 can engage with the driving gear 185.

The first transmission gear 186 may further include a helical gear disposed at a lower side of the spiral bevel gear as a second gear.

The plurality of transmission gears 186, 187, 188 and 189 may further include a second transmission gear 187 engaged with the first transmission gear 186.

The second transmission gear 187 may be a two-stage helical gear. In other words, the second transmission gear 187 includes two helical gears arranged vertically, and the upper helical gear can be connected to the helical gear of the first transmission gear 186.

The second transmission gear 187 may be a two-stage helical gear. In other words, the second transmission gear 187 includes two helical gears arranged vertically, and the upper helical gear can be connected to the helical gear of the first transmission gear 186.

The plurality of transmission gears 186, 187, 188 and 189 may further include a third transmission gear 188 engaged with the second transmission gear 187.

The third transmission gear 188 may also be a two-stage helical gear. In other words, the third transmission gear 188 includes two helical gears arranged vertically, and the upper helical gear may be connected to the lower helical gear of the second transmission gear 187.

The plurality of transmission gears 186, 187, 188 and 189 may further include a fourth transmission gear 189 engaged with the lower helical gear of the third transmission gear 188. The fourth transmission gear 189 may be a helical gear.

The transmission shaft 190 may be coupled to the fourth transmission gear 189. The transmission shaft 190 may be coupled to penetrate the fourth transmission gear 189. The transmission shaft 190 may be rotated together with the fourth transmission gear 189.

Accordingly, an upper bearing 191 is coupled to the upper end of the transmission shaft 190 passing through the fourth transmission gear 189 and a lower bearing 191*a* is coupled to the transmission shaft 190 at the lower side of the fourth transmission gear 189.

Figure 19:
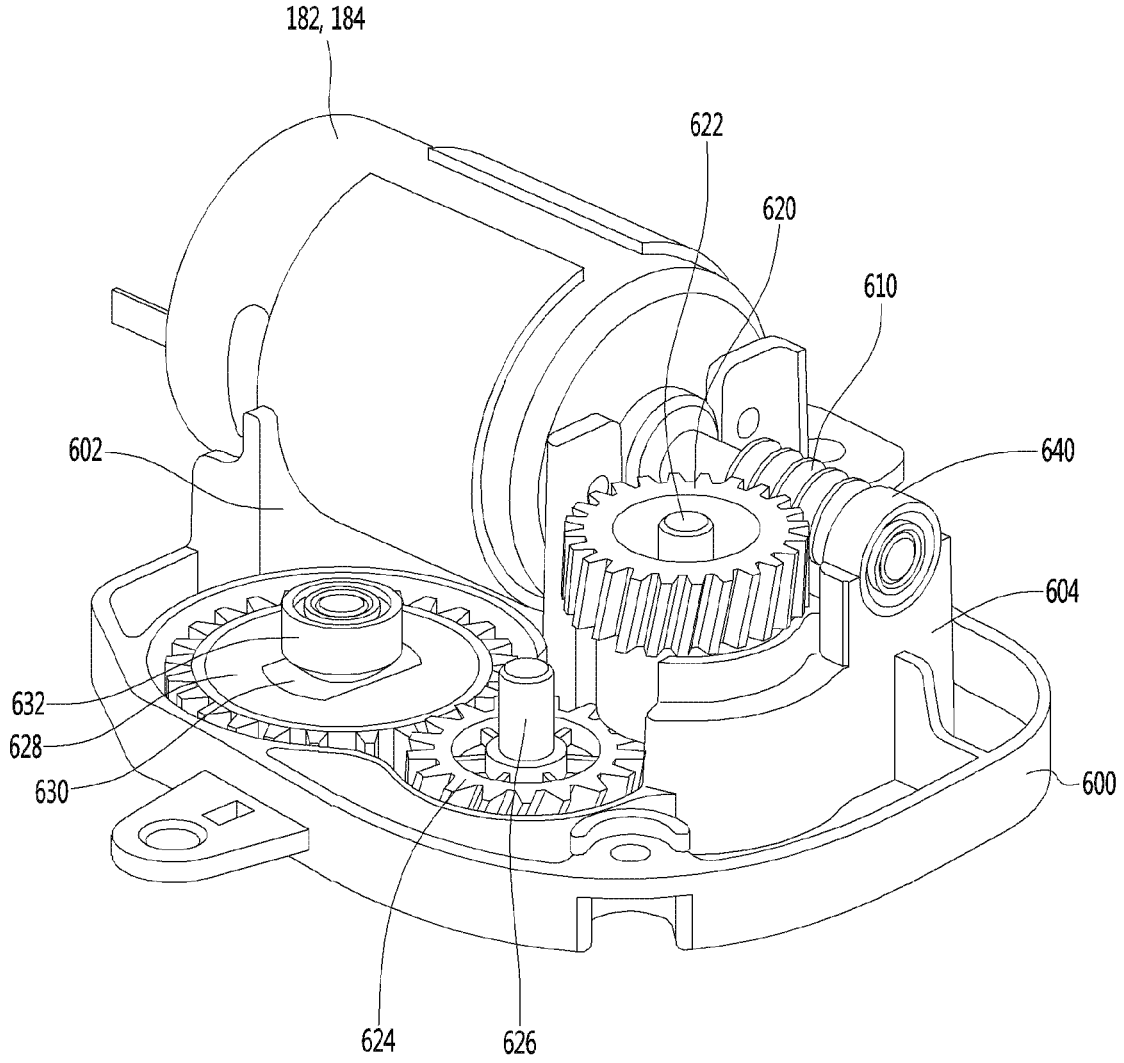
FIG. 19 is a view illustrating a state where a power transmission unit is coupled to a driving motor according to another embodiment of the present invention.

FIG. 19 is a view illustrating a state where a power transmitting unit is coupled to a driving motor according to another embodiment of the present invention.

The present embodiment is the same as the previous embodiment in other portions but differs in the configuration of the power transmitting portion. Therefore, only the characteristic parts of the present embodiment will be described below.

Referring to FIG. 19, the power transmitting unit of the present embodiment may include a driving gear 610 connected to the shafts of the driving motors 182 and 184.

The driving gear 610 may be a worm gear. The rotational shaft of the driving gear 610 may extend in the horizontal direction. Since the driving gear 610 is rotated together with the rotating shaft of the driving gear 610, a bearing 640 may be connected to the driving gear 610 for smooth rotation.

The first housing 600 may include a motor support portion 602 for supporting the driving motors 182 and 184 and a bearing support portion 604 for supporting the bearings 640.

The power transmission unit may further include a plurality of transmission gears 620, 624 and 628 for transmitting the rotational force of the driving gear 610 to the rotation plates 420 and 440.

The plurality of transmission gears 620, 624 and 628 may include a first transmission gear 620 engaged with the driving gear 610. The first transmission gear 620 may include an upper worm gear to engage with the driving gear 610.

Since the driving gear 610 and the second transmission gear 620 mesh with each other in the form of a worm gear, there is an advantage that noise is reduced by friction in a process in which the rotational force of the driving gear 610 is transmitted to the second transmission gear 620.

The first transmission gear 620 may include a helical gear disposed at the lower side of the upper worm gear as a second gear.

The first transmission gear 620 may be rotatably connected to a first shaft 622 extending in the vertical direction. The first shaft 622 may be fixed to the first housing 600.

Accordingly, the first transmission gear 620 can be rotated with respect to the fixed first shaft 622. According to the present embodiment, since the first transmission gear 620 is configured to rotate with respect to the first shaft 622, there is an advantage that a bearing is unnecessary.

The plurality of transmission gears 620, 624, and 628 may further include a second transmission gear 624 engaged with the first transmission gear 620. The second transmission gear 624 is, for example, a helical gear.

The second transmission gear 624 may be rotatably connected to a second shaft 626 extending in the vertical direction. The second shaft 626 may be fixed to the first housing 600.

Accordingly, the second transmission gear 624 can be rotated with respect to the fixed second shaft 626. According to the present embodiment, since the second transmission gear 624 is configured to rotate with respect to the second shaft 626, there is an advantage that no bearing is required.

The plurality of transmission gears 620, 624, and 628 may further include a third transmission gear 628 engaged with the second transmission gear 624. The third transmission gear 628 is, for example, a helical gear.

The third transmission gear 628 may be connected to a transmission shaft 630 connected to the rotation plates 420 and 440. The transmission shaft 630 may be connected to the third transmission gear 628 and rotated together with the third transmission gear 628.

A bearing 632 may be coupled to the transmission shaft 630 for smooth rotation of the transmission shaft 630.

<Disposition of Driving Device in Nozzle Base>

Figure 20:
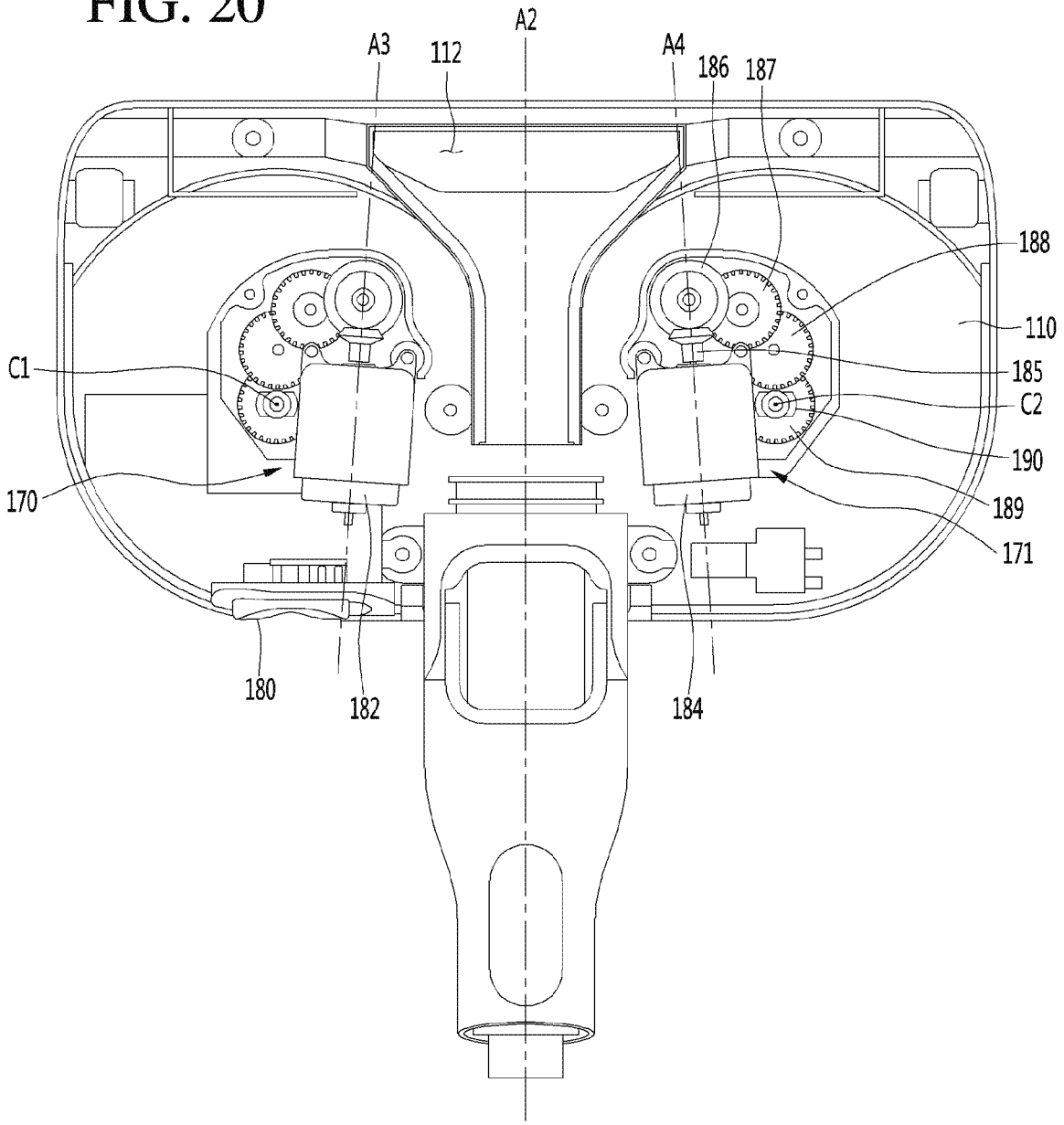
FIG. 20 is a plan view illustrating a state where a driving device is installed on a nozzle base according to an embodiment of the present invention.
Figure 21:
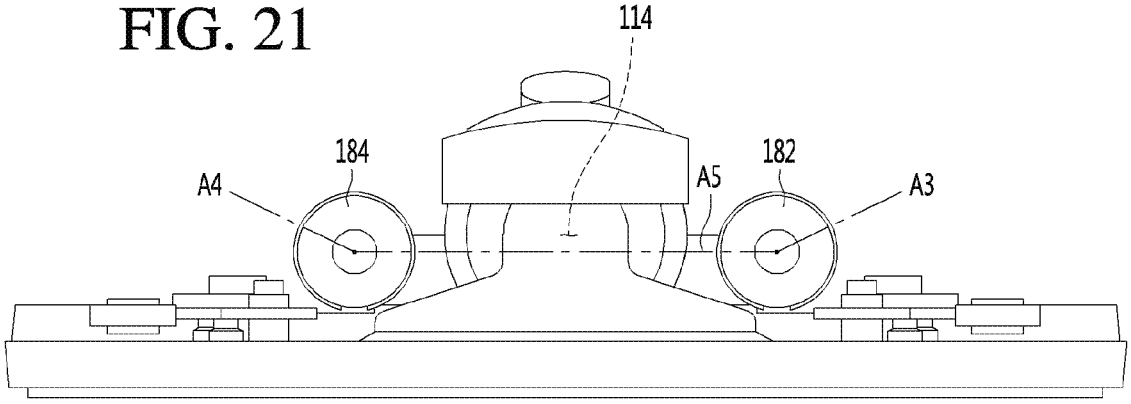
FIG. 21 is a front view illustrating a state where a driving device is installed on a nozzle base according to an embodiment of the present invention.

FIG. 20 is a plan view illustrating a state where a driving device is installed on a nozzle base according to an embodiment of the present invention, and FIG. 21 is a front view illustrating a state where a driving device is installed on a nozzle base according to an embodiment of the present invention.

Particularly, FIG. 20 illustrates a state where the second housing of the motor housing is removed.

Referring to FIG. 20 and FIG. 21, the driving devices 170 and 171 may be disposed on the nozzle base 110 so as to be spaced apart from each other in the lateral direction, as described above.

A centerline A2 of the second flow path 114 may be positioned between the first driving device 170 and the second driving device 171. By this disposition, the weight of each of the driving devices 170 and 171 can be evenly distributed to the right and left of the nozzle 1.

The axis A3 of the first driving motor 182 and the axis A4 of the second driving motor 184 may extend in the front and rear direction so that the height of the nozzle 1 is prevented from being increased by the driving motors 182.

The axis A3 of the first driving motor 182 and the axis A4 of the second driving motor 184 may be parallel or may be disposed at a predetermined angle.

In the present embodiment, the imaginary line A5 connecting the axis A3 of the first driving motor 182 and the axis A4 of the second driving motor 184 passes through the second flow path 114. This is because each of the driving motors 182 and 184 is positioned close to the rear side of the nozzle 1 so that the increase in the height of the nozzle 1 by the driving motors 182 and 184 can be prevented.

In addition, in a state where the driving gears 185 and 185 are connected to the shaft of each of the driving motors 182 and 184, so that the increase in the height of the nozzle 1 is minimized by each of the driving devices 170 and 171, the driving gear 185 may be positioned between the driving motors 182 and 184 and the first flow path 112.

In this case, since the driving motors 182 and 184 having the longest vertical length of the driving devices 170 and 171 are positioned as close as possible to the rear side in the nozzle main body 10, the increase in height of a side of the front end portion of the nozzle 1 can be minimized.

Since the driving devices 170 and 171 are positioned close to the rear side of the nozzle 1 and the water tank 200 is positioned above the driving devices 170 and 171, the center of gravity of the nozzle 1 may be pulled toward the rear side of the nozzle 1 due to the weight of the water in the water tank 200 and the driving devices 170 and 171.

Accordingly, in the present embodiment, the connection chamber (see 226 of FIG. 6) of the water tank 200 is positioned between the first flow path 112 and the driving devices 170 and 170 with respect to the front and rear directions of the nozzle 1.

Meanwhile, in the present embodiment, the rotation centers C1 and C2 of the rotation plates 420 and 440 coincide with the rotation center of the transmission shaft 190.

The axes A3 and A4 of the driving motors 182 and 184 can be positioned in the region between the rotation centers C1 and C2 of the rotation plates 420 and 440.

In addition, the driving motors 182 and 184 may be positioned in a region between the rotation centers C1 and C2 of the rotation plates 420 and 440.

In addition, each of the driving motors 182 and 184 may be disposed so as to overlap with the imaginary line connecting the first rotation center C1 and the second rotation center C2 in the vertical direction.

<Rotation Plate>

Figure 22:
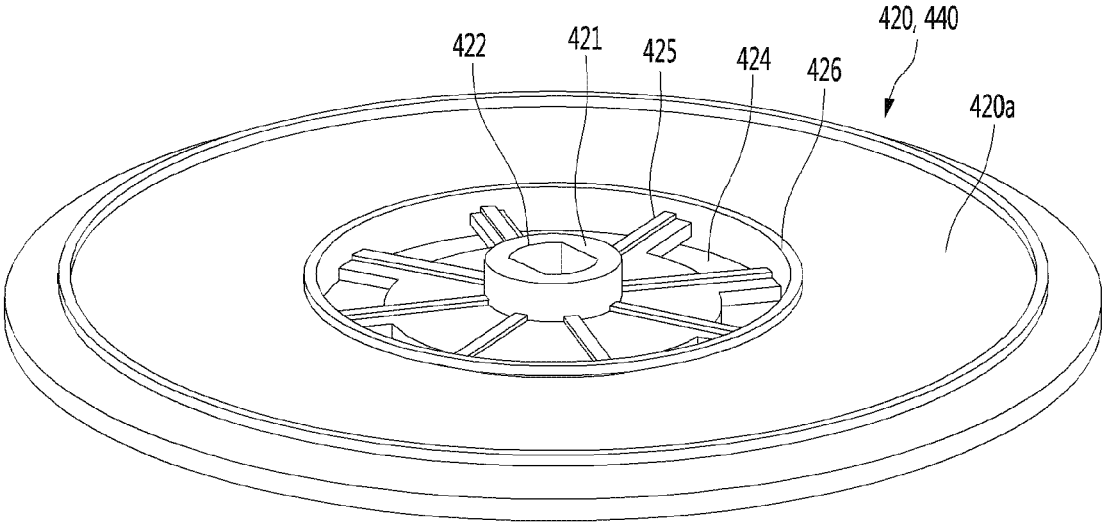
FIG. 22 is a top view illustrating a rotation plate according to an embodiment of the present invention as viewed from above.
Figure 23:
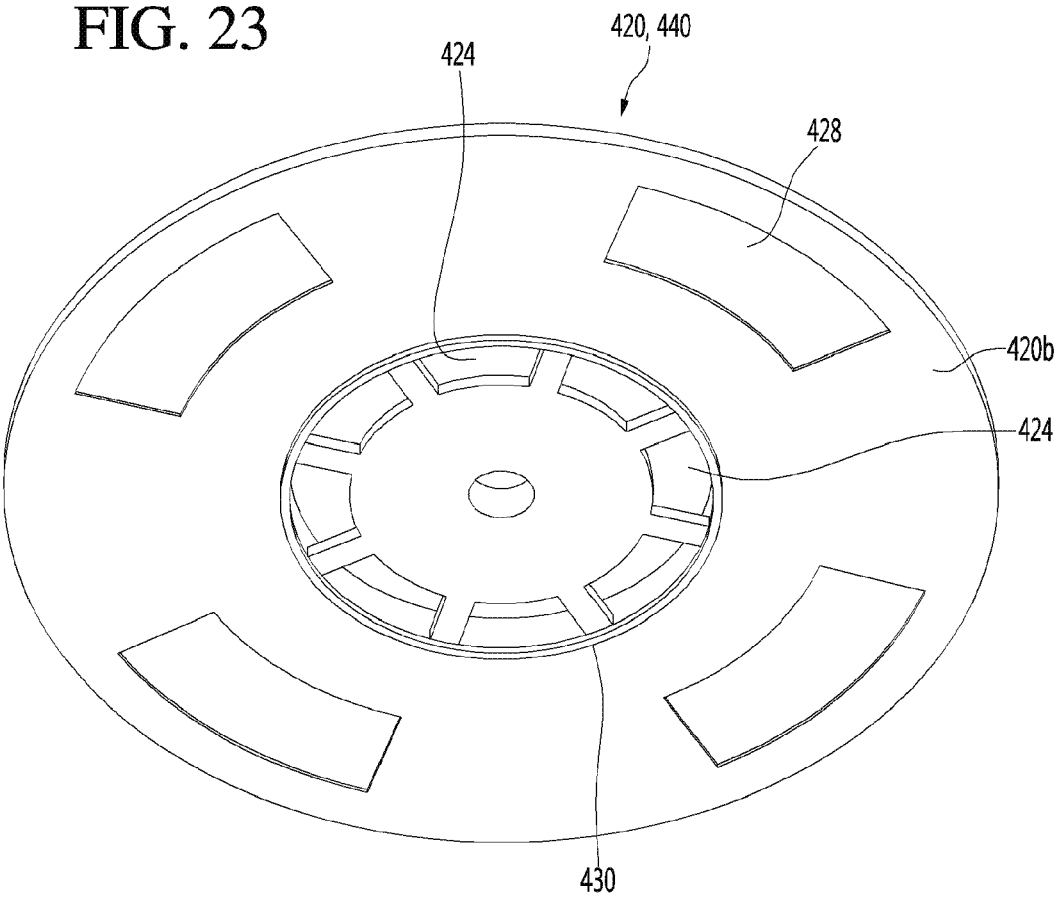
FIG. 23 is a bottom view illustrating a rotation plate according to an embodiment of the present invention as viewed from below.

FIG. 22 is a top view illustrating a rotation plate according to an embodiment of the present invention as viewed from above, and FIG. 23 is a bottom view illustrating a rotation plate according to an embodiment of the present invention as viewed from below.

Referring to FIG. 22 and FIG. 23, each of the rotation plates 420 and 440 may be formed in a disc shape so as to prevent mutual interference during the rotation process. A shaft coupling unit 421 for coupling the transmission shaft 190 may be provided at a central portion of each of the rotation plates 420 and 440.

For example, the transmission shaft 190 may be inserted into the shaft coupling unit 421. For this purpose, a shaft receiving groove 422 for inserting the transmission shaft 190 may be formed in the shaft coupling unit 421.

A fastening member may be drawn into the shaft coupling unit 421 from below the rotation plates 420 and 440 and be fastened to the transmission shaft 190 in a state where the transmission shaft 190 is coupled to the shaft coupling unit 421.

The rotation plates 420 and 440 may include a plurality of water passage holes 424 disposed outwardly of the shaft coupling unit 421 in the radial direction.

In the present embodiment, since the rotation plates 420 and 440 are rotated in a state where the mops 402 and 404 are attached to the lower sides of the rotation plates 420 and 440, so as to smoothly supply water to the mops 402 and 404 through the rotation plates 420 and 440, the plurality of water passage holes 424 may be spaced circumferentially around the shaft coupling unit 421.

The plurality of water passage holes 424 may be defined by a plurality of ribs 425. At this time, each of the ribs 425 may be positioned lower than the upper surface 420*a* of the rotation plates 420 and 440.

Since the rotation plates 420 and 440 rotate, centrifugal force acts on the rotation plates 420 and 440. It is necessary to prevent the water sprayed to the rotation plates 420 and 440 from flowing radially outward in a state where the water cannot pass through the water passage holes 424 in the rotation plates 420 and 440 due to the centrifugal force.

Therefore, a water blocking rib 426 may be formed on the upper surface 420*a* of the rotation plates 420 and 440 at a radially outside of the water passage hole 424. The water blocking ribs 426 may be formed continuously in the circumferential direction. In other words, the plurality of water passage holes 424 may be positioned in the inner region of the water blocking ribs 426. The water blocking ribs 426 may be formed in the form of a circular ring, for example.

An installation groove 428 may be formed on the lower surface 420*b* of the rotation plates 420 and 440 to provide attachment means for attaching the mops 402 and 404. The attachment means can be, for example, a velcro.

A plurality of installation grooves 428 may be spaced apart in the circumferential direction with respect to the rotation centers C1 and C2 of the rotation plates 420 and 440. Therefore, a plurality of attachment means may be provided on the lower surface 420*b* of the rotation plates 420 and 440.

In the present embodiment, the installation groove 428 may be disposed radially outward of the water passage hole 424 with respect to the rotation centers C1 and C2 of the rotation plates 420 and 440.

For example, the water passage hole 424 and the installation groove 428 may be sequentially arranged radially outward from the rotation centers C1 and C2 of the rotation plates 420 and 440.

The lower surface 420*b* of the rotation plates 420 and 440 may be provided with a contact rib 430 which contacts the mop 402 or 404 in a state where the mop 402 or 404 is attached to the attachment means.

The contact ribs 430 may protrude downward from a lower surface 420*b* of the rotation plates 420 and 440.

The contact ribs 430 are disposed radially outward of the water passage holes 424 and may be formed continuously in the circumferential direction. For example, the contact rib 430 may be formed in a circular ring shape.

Since the mops 402 and 404 can be deformed by itself, for example, as a fiber material, gaps can exist between the mops 402 and 404 and the lower surfaces 420*b* of the rotation plates 420 and 440 in a state where the mops 402 and 404 are attached to the rotation plates 420 and 440 by the attaching means.

When the gap existing between the mops 402 and 404 and the lower surfaces 420*b* of the rotation plates 420 and 440 is large, there is a fear that water is not absorbed to the mops 402 and 404 in a state of passing through the water passage hole 424 and flows to the outside through the gap between the lower surfaces 420*b* of the rotation plates 420 and 440 and the upper surface of the mops 402 and 404.

However, according to the present embodiment, when the mops 402 and 404 are coupled to the rotation plates 420 and 440, the contact ribs 430 can be brought into contact with the mops 402 and 404, the nozzle 1 is placed on the floor, the contact rib 430 presses the mops 402, 404 by the load of the nozzle 1.

Accordingly, the contact ribs 430 prevent the formation of the gap between the lower surfaces 420*b* of the rotation plates 420 and 440 and the upper surfaces of the mops 402 and 404 and thus water to pass through the water passage holes 424 can be smoothly supplied to the mops 402 and 404.

<Water Supply Flow Path>

Figure 24:
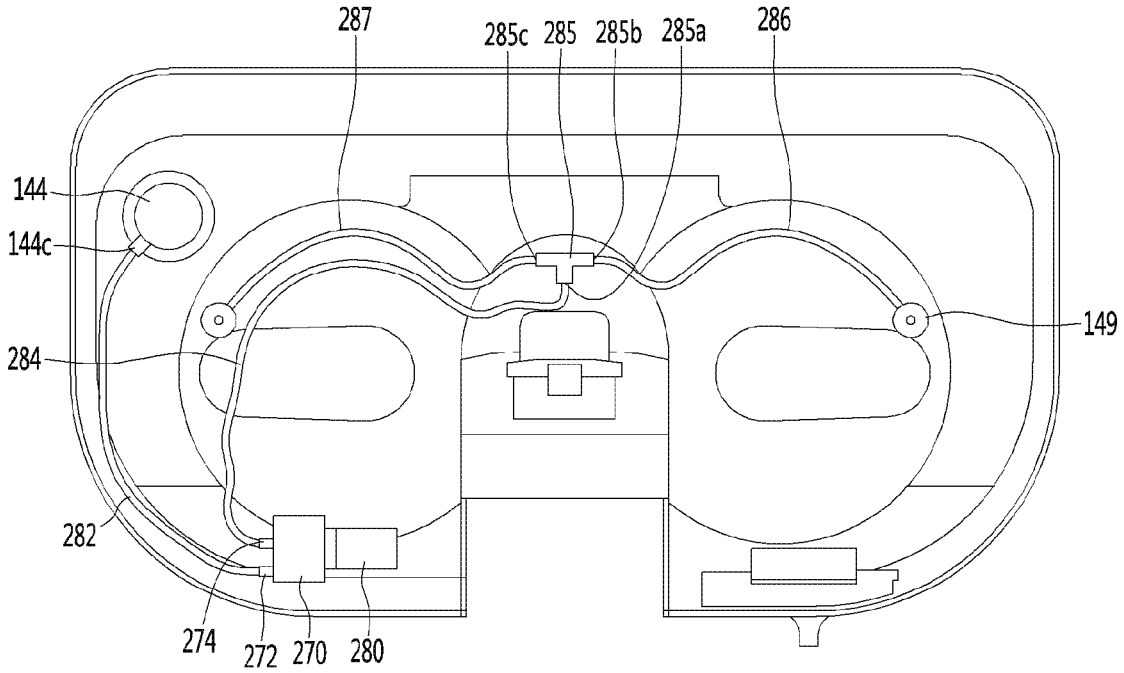
FIG. 24 is a view illustrating a water supply flow path for supplying water of a water tank to the rotation cleaning unit according to an embodiment of the present invention.
Figure 25:
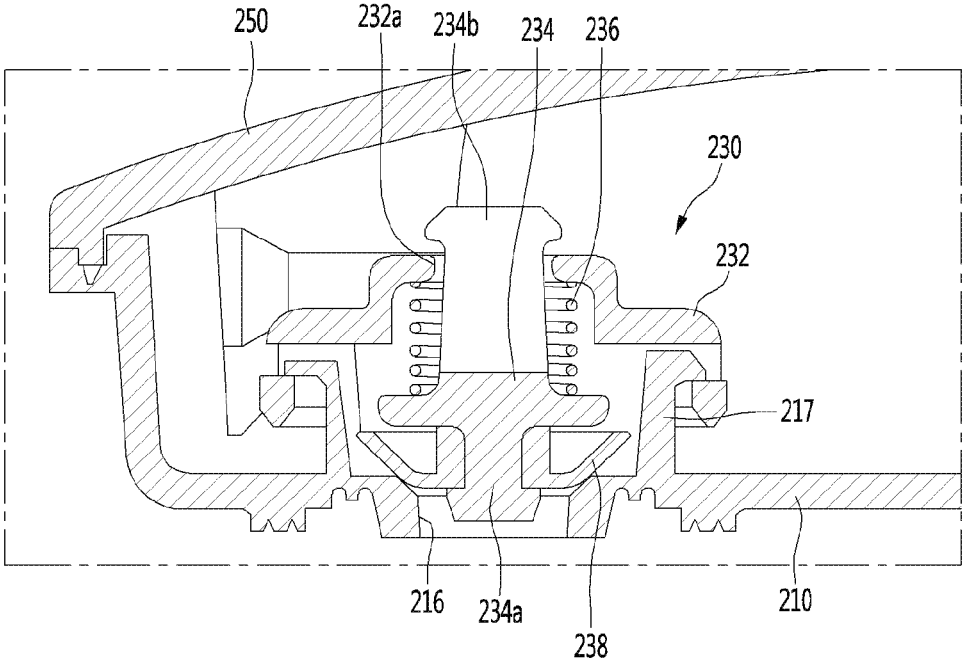
FIG. 25 is a view illustrating a valve in a water tank according to an embodiment of the present invention.
Figure 26:
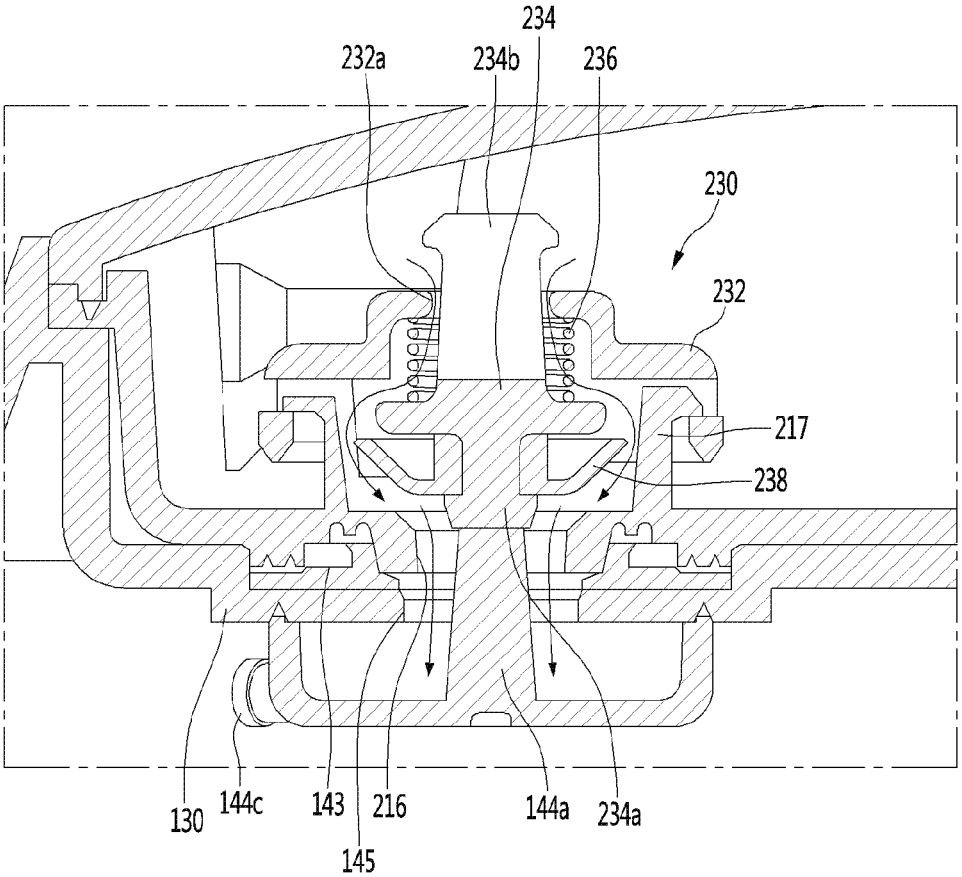
FIG. 26 is a view illustrating a state where the valve opens the discharge port in a state where the water tank is mounted on the nozzle housing.

FIG. 24 is a view illustrating a water supply flow path for supplying water of a water tank to the rotation cleaning unit according to an embodiment of the present invention, FIG. 25 is a view illustrating a valve in a water tank according to an embodiment of the present invention, and FIG. 26 is a view illustrating a state where the valve opens the discharge port in a state where the water tank is mounted on the nozzle housing.

Figure 27:
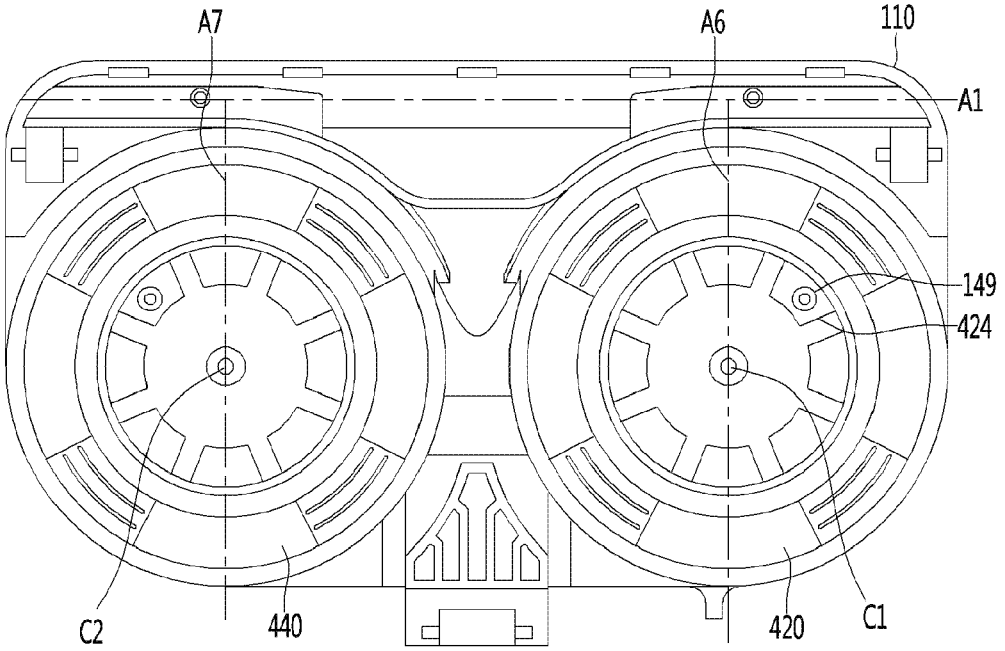
FIG. 27 is a view illustrating a state where a rotation plate according to an embodiment of the present invention is coupled to a nozzle main body.
Figure 28:
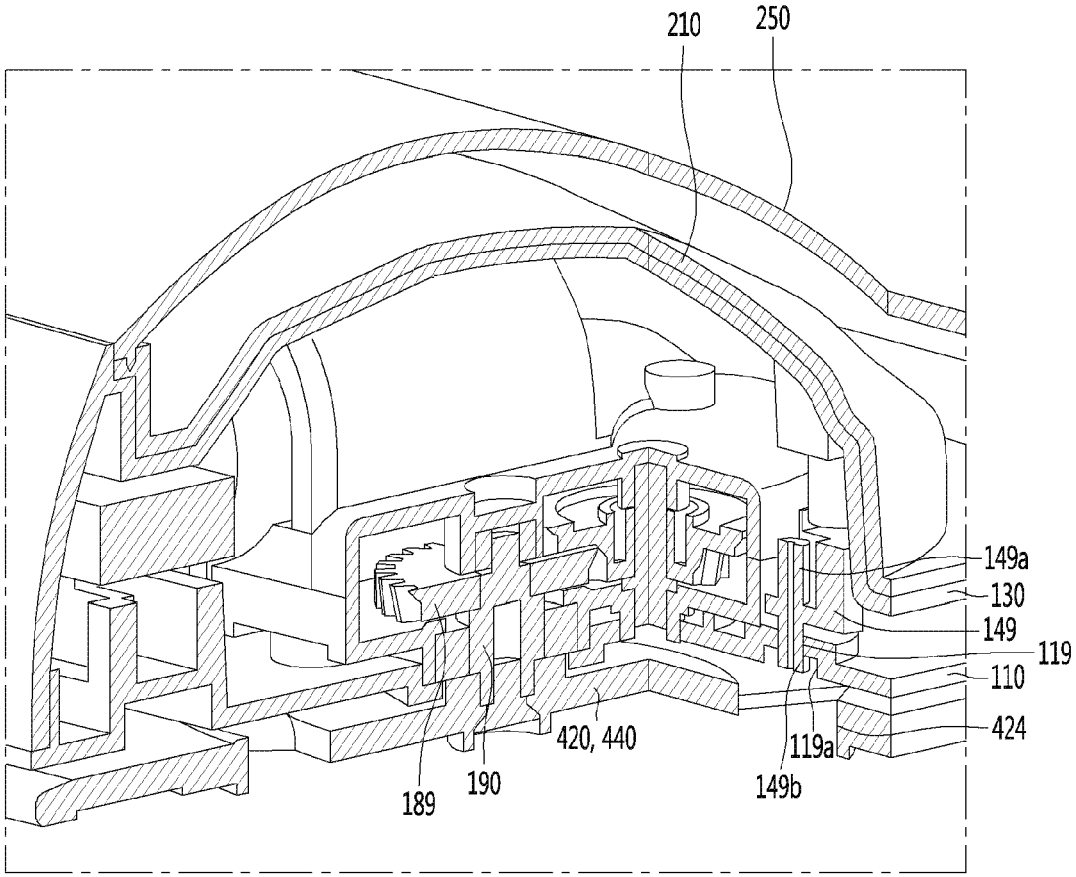
FIG. 28 is a view illustrating a disposition of a spray nozzle in a nozzle main body according to an embodiment of the present invention.

FIG. 27 is a view illustrating a state where a rotation plate according to an embodiment of the present invention is coupled to a nozzle main body and FIG. 28 is a view illustrating a disposition of a spray nozzle in a nozzle main body according to an embodiment of the present invention.

Figure 29:
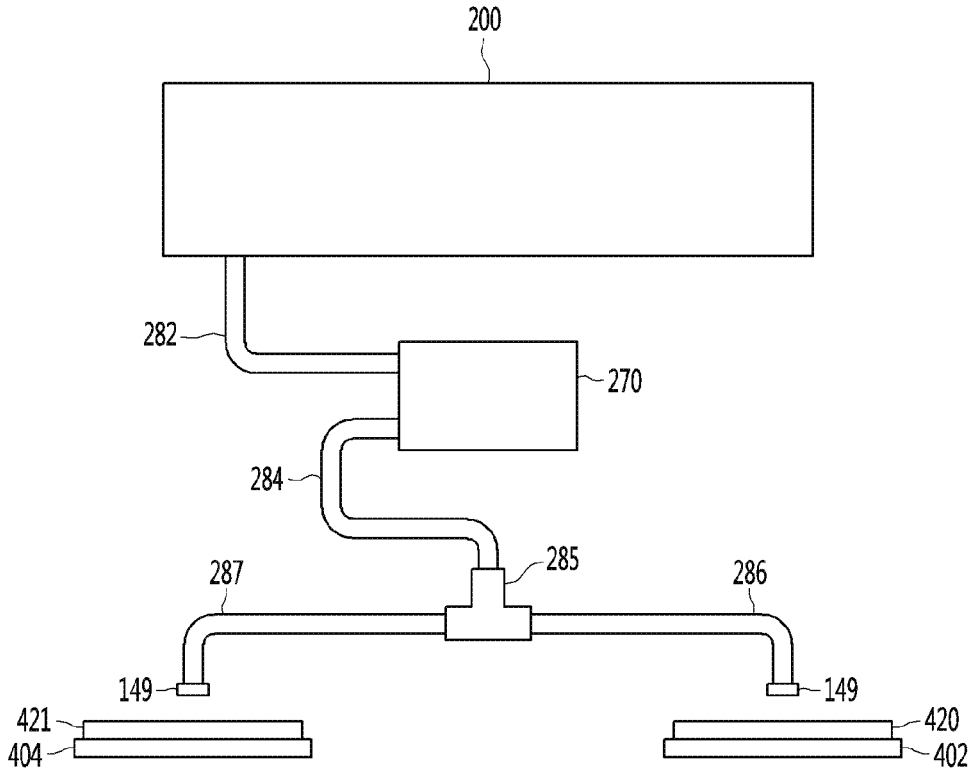
FIG. 29 is a conceptual diagram illustrating a process of supplying water to a rotation cleaning unit in a water tank according to an embodiment of the present invention.

FIG. 29 is a conceptual diagram illustrating a process of supplying water to a rotation cleaning unit in a water tank according to an embodiment of the present invention.

Referring to FIG. 24 to FIG. 29, the water supply flow path of the present embodiment includes a first supply tube 282 connected to the valve operating unit 144, a water pump 270 connected to the first supply tube 282, and a second supply tube 284 connected to the water pump 270.

The water pump 270 may include a first connection port 272 to which the first supply tube 282 is connected and a second connection port 274 to which the second supply tube 284 is connected. On the basis of the water pump 270, the first connection port 272 is an inlet, and the second connection port 274 is a discharge port.

In addition, the water supply flow path may further include a connector 285 to which the second supply tube 284 is connected.

The connector 285 may be formed such that the first connection unit 285*a*, the second connection unit 285*b*, and the third connection unit 285*c* are arranged in a T-shape. The second connection tube 284 may be connected to the first connection unit 285*a*.

The water supply flow path may further include a first branch tube 286 connected to the second connection unit 285*b* and a second branch tube 287 connected to the third connection unit 285*b*.

Accordingly, the water flowing through the first branch tube 286 may be supplied to the first rotation cleaning unit 40 and may be supplied to the second rotation cleaning unit 41 flowing through the second branch tube 287.

The connector 285 may be positioned at the center portion of the nozzle main body 10 such that each of the branch tubes 286 and 287 has the same length.

For example, the connector 285 may be positioned below the flow path cover 136 and above the flow path forming portion 150. In other words, the connector 285 may be positioned directly above the second flow path 114. Thus, substantially the same amount of water can be dispensed from the connector 285 to each of the branch tubes 286 and 287.

In the present embodiment, the water pump 270 may be positioned at one point on the water supply flow path.

At this time, the water pump 270 may be positioned between the valve operating unit 144 and the first connection unit 285*a* of the connector 285 so that water can be discharged from the water tank 200 using a minimum number of the water pumps 270.

In the present embodiment, the water pump 270 may be installed in the nozzle cover 130 in a state where the water pump 270 is positioned close to the portion where the valve operating unit 144 is installed.

As an example, the valve operating unit 144 and the water pump 270 may be provided on one side of both sides of the nozzle main body 10 with respect to the centerline A2 of the second flow path 114.

Therefore, the length of the first supply tube 282 can be reduced, and accordingly, the length of the water supply flow path can be reduced.

Each of the branch tubes 286 and 287 may be connected to the spray nozzle 149. The spray nozzle 149 can also form the water supply flow path of the present invention.

The spray nozzle 149 may include a connection unit 149*a* to be connected to each of the branch tubes 186 and 187 as described above.

The spray nozzle 149 may further include a nozzle end portion 149*b*. The nozzle end portion 149*b* extends downward through the nozzle hole 119. In other words, the nozzle end portion 149*b* may be disposed on the outside of the nozzle housing 100.

When the nozzle end portion 149*b* is positioned outside the nozzle housing 100, water sprayed through the nozzle end portion 149*b* can be prevented from being drawn into the nozzle housing 100.

At this time, so as to prevent the nozzle end portion 149*b* exposed to the outside of the nozzle housing 100 from being damaged, grooves 119*a* recessed upward are formed in the bottom of the nozzle base 110, the nozzle end portion 149*b* may be positioned in the groove 119*a* in a state of passing through the nozzle hole 119. In other words, the nozzle hole 119 may be formed in the groove 119*a*.

The nozzle end portion 149*b* may be disposed to face the rotation plates 420 and 440 in the groove 119*a*.

Therefore, the water sprayed from the nozzle end portion 149*b* can pass through the water passage hole 424 of the rotation plates 420 and 440.

A line perpendicularly connecting the first rotation center C1 and the centerline A1 of the first flow path 112 may be referred to as a first connection line A6, and a line perpendicularly connecting the second rotation center C2 and an axis A1 of the first flow path 112 may be referred to as a second connecting line A7.

At this time, the first connection line A6 and the second connection line A7 may be positioned in a region between a pair of spray nozzles 149 for supplying water to each of the rotation cleaning units 40 and 41.

This is because the spray nozzle 149 is disposed to prevent interference with these parts, since the components constituting the driving devices 170 and 171 exist in the area between the first connection line A6 and the second connection line A7.

In addition, the horizontal distance between the spray nozzle 149 and the centerline A1 of the first flow path 112 is shorter than the horizontal distance between each of the rotation centers C1 and C2 and the centerline A1 of the first flow path 112.

Meanwhile, the valve 230 may include a movable unit 234, an opening and closing unit 238, and a fixing unit 232.

The fixing unit 232 may be fixed to a fixing rib 217 protruding upward from the first body 210 of the water tank 200.

The fixing unit 232 may have an opening 232*a* through which the movable unit 234 passes.

The fixing unit 232 restricts the movable unit 234 from moving upward at a predetermined height from the fixing unit 232 in a state where the fixing unit 232 is coupled with the fixing rib 217.

The movable unit 234 can be moved in the vertical direction in a state where a portion of the movable unit 234 passes through the opening 232*a*. In a state where the movable unit 234 is moved upward, water can pass through the opening 232*a*.

The movable unit 234 may include a first extension portion 234*a* extending downward and coupled with the opening and closing unit 238 and a second extension portion 234*b* extending upwardly and passing through the opening 232*a*.

The movable unit 234 may be elastically supported by an elastic member 236. One end of the elastic member 263, as a coil spring, for example, may be supported by the fixed portion 232 and the other end may be supported by the movable unit 234.

The elastic member 236 provides a force to the movable unit 234 to move the movable unit 234 downward.

The opening/closing unit 238 can selectively open the discharge port 216 by moving the movable unit 234 up and down.

At least a portion of the opening/closing unit 238 may have a diameter larger than the diameter of the discharge port 216 so that the opening/closing unit 238 may block the discharge port 216.

The opening/closing unit 238 may be formed of, for example, a rubber material so that the leakage of water is prevented in a state where the opening/closing unit 238 blocks the discharge port 216.

The elastic force of the elastic member 236 is applied to the movable unit 234 so that a state where the opening and closing unit 238 blocks the discharge port 216 can be maintained unless an external force is applied to the movable unit 234.

The movable unit 234 can be moved by the valve operating unit 144 in the process of mounting the water tank 200 to the nozzle main body 10.

The valve operating unit 144 is coupled to the nozzle cover 130 from below the nozzle cover 130 as described above. A water passage opening 145 through which the water discharged from the water tank 200 passes may be formed in the nozzle cover 130.

The valve operating unit 144 may include a pressing portion 144*a* passing through the water passage openinge 145. The pressing portion 144*a* may protrude upward from the bottom of the nozzle cover 130 in a state of passing through the water passage opening 145 of the nozzle cover 130.

The valve operating unit 144 may form a water supply flow path together with the bottom of the nozzle cover 130. A connection tube 144*c* for connecting the first supply tube 282 may be provided at one side of the valve operating unit 144.

The diameter of the water passage opening 145 may be larger than the outer diameter of the pressing portion 144*a* so that water flows smoothly in a state where the pressing portion 144*a* passes through the water passage opening 145.

When the water tank 200 is mounted on the nozzle main body 10, the pressing portion 144*a* is drawn into the discharge port 216 of the water tank 200. The pressing portion 144*a* presses the movable unit 234 in a process in which the pressing portion 144*a* is being drawn into the discharge port 216 of the water tank 200.

The movable unit 234 is lifted and the opening and closing unit 238 coupled to the movable unit 234 moves upward together with the movable unit 234 to be separated from the discharge port 216 to open the discharge port 216.

The water in the water tank 200 is discharged through the discharge port 216, flows along the valve operating unit 144 through the water passage opening 145 and then is supplied to the first supply tube 282 connected to the connection tube 144*c*.

The water supplied to the first supply tube 282 flows into the second supply tube 284 after being drawn into the water pump 270. The water flowing into the second supply tube 284 flows to the first branch tube 286 and the second branch tube 287 by the connector 285. The water flowing into each of the branch tubes 286 and 287 is sprayed from the spray nozzle 149 toward the rotation cleaning units 40 and 41.

The water sprayed from the spray nozzle 149 is supplied to the mops 402 and 404 after passing through the water passage holes 424 of the rotation plates 420 and 440. The mops 402 and 404 are rotated while absorbing the supplied water to wipe the floor.

Figure 30:
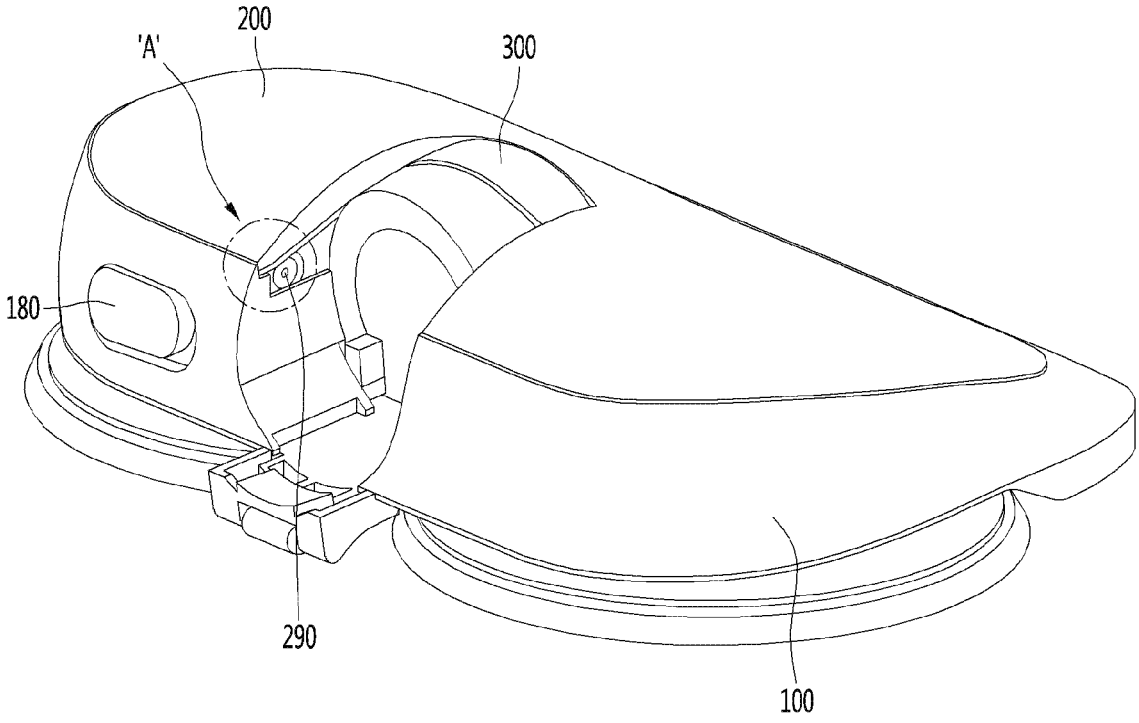
FIG. 30 is a perspective view illustrating the nozzle for the cleaner from which a connection tube is separated according to an embodiment of the present invention as viewed from the rear side.
Figure 31:
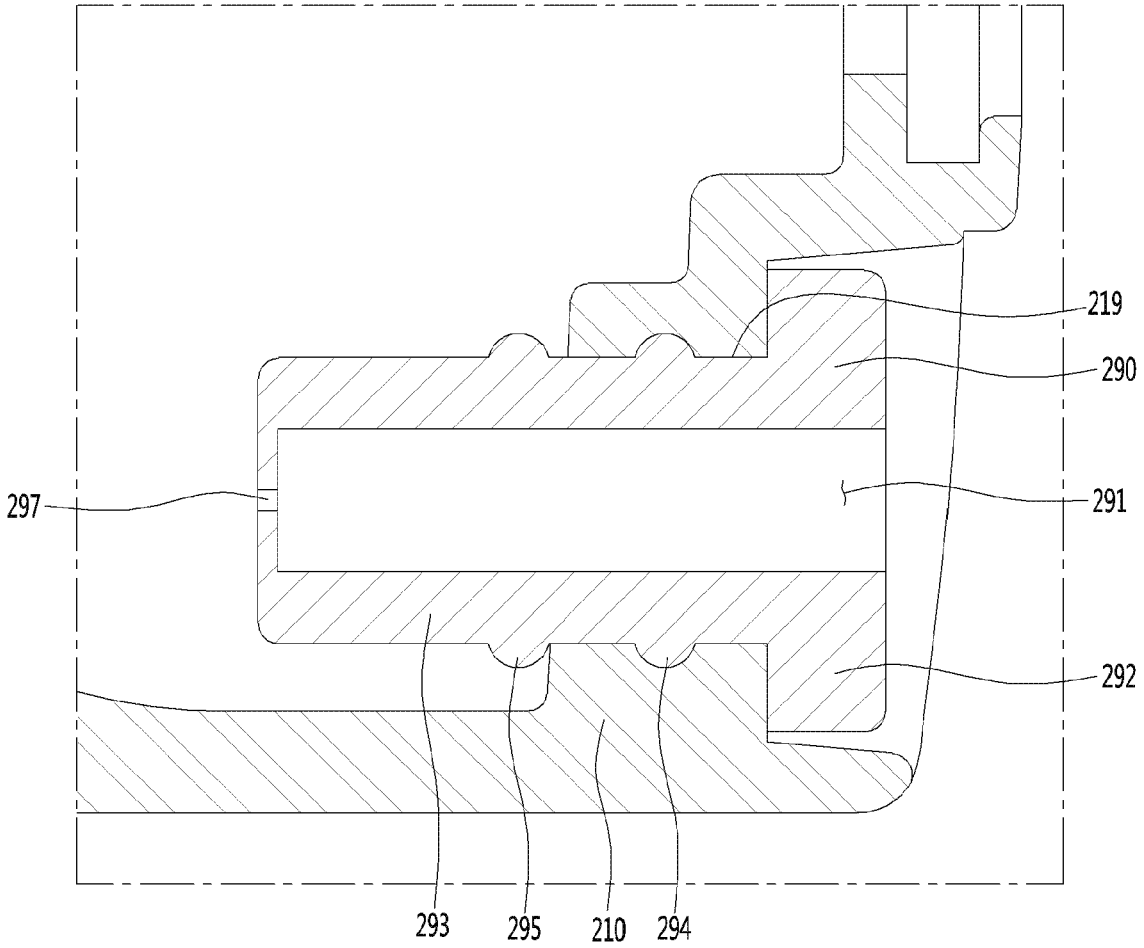
FIG. 31 is a sectional view illustrating area 'A' in FIG. 30.
Figure 32:
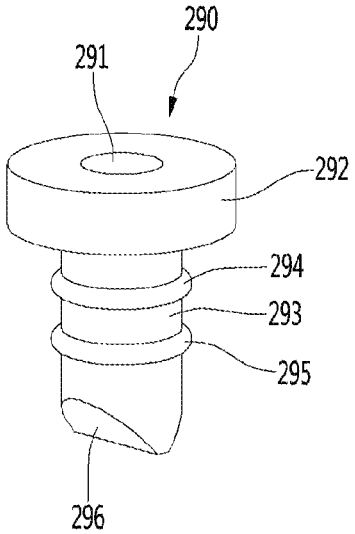
FIG. 32 is a perspective view illustrating the gasket of FIG. 31.

FIG. 30 is a perspective view illustrating the nozzle for the cleaner from which a connection tube is separated according to an embodiment of the present invention as viewed from the rear side, FIG. 31 is a sectional view illustrating area 'A' in FIG. 30, and FIG. 32 is a perspective view illustrating the gasket of FIG. 31.

Referring to FIG. 30 to FIG. 32, at least one air hole 219 for introducing outside air may be formed in the water tank 200. Hereinafter, as an example, one air hole 219 is formed in the water tank 200, but a plurality of the air holes 219 may be provided.

The air holes 219 may be formed on one side of the water tank 200.

In detail, the gasket 290 may be press-fitted into the air hole 219.

The gasket 290 can guide the outside air into the interior space of the water tank 200.

The gasket 290 may be referred to as a check valve in that the outside air flows into the water tank 200 while the water in the water tank 200 is interrupted so as not to be discharged to the outside.

The gasket 290 may be formed of a material deformed in shape by an external force. For example, the gasket 290 may be formed of polyethylene material but is not limited thereto.

The gasket 290 may include a cylindrical body 293, for example.

An end portion of one side of the body 293 may be received inside the water tank 200 through the air hole 219. The other end portion of the body 293 may be exposed to the outside of the water tank 200.

At least one sealing protrusion 294 and 295 may be formed on the outside of the body 293. The outer diameter of the sealing protrusions 294 and 295 may be larger than the inner diameter of the air hole 219. When the sealing protrusions 294 and 295 are formed as described above, leakage between the body 293 and the air holes 219 can be prevented.

In a case where a plurality of the sealing protrusions 294 and 295 are formed, a portion of the sealing protrusions 294 and 295 may be positioned inside the water tank 200.

A flange 292 having an outer diameter larger than that of the body 293 and the sealing protrusions 294 and 295 may be formed at the other end portion of the body 293. The flange 292 has a larger diameter than the air hole 219. The entirety of the gasket 290 is prevented from entering the inside of the water tank 200 by the flange 292.

In addition, the gasket 290 may be formed with an air flow path 291 through which air flows in the central portion thereof and a slit 297 may be formed at the other end portion thereof. At this time, the other end portion of the gasket 290 may contact water in the water tank 200.

In addition, so that the slit 297 formed at the other end portion of the gasket 290 is blocked by the pressure of water, the gasket 290 is formed such that the sectional area of the gasket 290 decreases from one point to the other end portion, and thus inclined surfaces 296 can be formed on the outer side.

In detail, the inclined surfaces 296 may be formed on both sides of the slit 297.

According to an embodiment, the water pressure is applied to the inclined surface 296 formed at the other end portion of the gasket 290 and thus the other end portion of the gasket 290 inwardly shrinks, and in this process, the slit 297 is blocked in a state where the inner pressure of the water tank 200 is not lowered (a state where water is not discharged).

Therefore, water in the water tank 200 is prevented from leaking to the outside through the slit 297.

In addition, the slit 297 is blocked by the water pressure of the water tank 200 so that the air is not supplied to the inner portion of the water tank 200 through the slit 297 in a state where no external force is applied to the gasket 290.

Meanwhile, outside air can be supplied to the water tank 200 through the gasket 290 in a state where the internal pressure of the water tank 200 is lowered (a state where water is discharged).

Specifically, when the pump motor 280 operates, the water in the water tank 200 is discharged through the discharge port 216 by the water pump 270. Then, the internal pressure of the water tank 200 is instantaneously lowered.

In addition, while the pressure applied to the inclined surface 296 of the gasket 290 is also lowered, the other end portion of the gasket 290 is restored to an original state thereof, and the slit 297 can be opened.

As described above, when the slit 297 is opened, the outside air can be supplied to the water tank 200 through the slit 297.

In a state where the slit 297 is opened, the surface tension of the water around the slit 297 and the force with which the external air flows are greater than the water pressure in the water tank 200, and water is not discharged to the outside of the water tank 200 through the slit 297.

According to the present embodiment, water in the water tank 200 can be prevented from being discharged to the outside through the gasket 290 when the water pump 270 is not operated.

In addition, in a state where the water pump 270 is operated, since air can be introduced into the water tank 200 through the slits 297 of the gasket 290, the water in the water tank 200 can be stably supplied to the mops 402 and 404.

According to the proposed embodiment, not only a flow path which can suction foreign matters on the floor but also the floor can be wiped by rotating the rotation plate to which the mop is attached, thereby improving floor cleaning performance.

In addition, the water tank can be mounted on the nozzle, and water can be supplied by the mop, thereby increasing convenience for the user.

In addition, the water pump can be operated by the pump motor, so that the water in the water tank can be stably supplied to the rotation cleaning unit during the cleaning process.

In addition, a driving device for driving the rotation plate is disposed on each of the left and right sides with respect to the center of the nozzle, a first flow path is formed at the front end portion of the nozzle, and a second flow path is formed at the center of the first flow path, there is an advantage that the overall height of the nozzle can be reduced. In a case where the overall height of the nozzle is reduced in this manner, there is an advantage in that it is possible to clean under furniture, a narrow gap, or the like.

In addition, in the present embodiment, since the size of the entire nozzle is reduced, even if the nozzle is eccentrically moved in the straight path during cleaning using the nozzle, there is an advantage that the user can easily move the nozzle in the desired direction (for example, straight path).

In addition, in a case where the number of revolutions of the driving motor is different, there is an advantage that the nozzle can be easily moved in a direction in which the user is desired. For example, in a case where the user desires to change the direction to the right, the number of rotations of the driving motor on the left side can be increased and in a case where the user desires to change the direction to the left side, the number of rotations of the driving motor on the right side can be increased.

In addition, since the flow path extends in the front and rear direction at the center of the nozzle and the driving device for rotating each of the rotation cleaning units is disposed on both sides of the flow path, the length of the air flow path for flowing the air is prevented from increasing, and thus the increase in flow path loss can be prevented.

In addition, since the water tank is divided into two chambers on the right and left sides, the two chambers communicate in the front portion of the water tank, and the two chambers are disposed so as to surround the periphery of the driving device, there is an advantage that the storage amount of the water tank increases.

In addition, as the diameter of the rotation plate is larger than the diameter of the sewing line portion an edge portion of the mop and smaller than the outer diameter of the mop, since the rotation plate can support the outer portion of the sewing line in the mop, it is possible to prevent the phenomenon that mutual friction between mops or overlapping between mops is caused by the deformation of the edge portion of the mop while the distance between the mops is reduced.

In addition, in a case where the diameter of the mop is 0.6 times or more the half of the width of the nozzle main body in the lateral direction, not only the area in which the mop can clean the floor facing the nozzle main body can be increased but also the area in which the mop can clean the floor which does not face the nozzle main body can be increased. Therefore, even if the nozzle is moved less, the floor of the same area can be cleaned using a mop.

In addition, since the two driving devices are disposed on both sides of the second flow path extending in the front and rear direction, the weight of the driving device can be uniformly distributed from the nozzle to the left and right.

In addition, since the connection chamber connecting the two chambers in the water tank is positioned between the first flow path and the plurality of driving devices, the center of gravity of the nozzle can be prevented from leaning toward the rear side of the nozzle.

In addition, according to the present embodiment, since the spray nozzle connected to the end portion of the water supply flow path is exposed to the outside of the nozzle housing, water sprayed from the spray nozzle can be prevented from being introduced into the nozzle housing.

In addition, according to the present embodiment, one discharge port is formed in the water tank, and the water supply flow path branches the water and supplies water to each of the plurality of rotation cleaning units, thereby minimizing portions in which water is leaked.

In addition, according to the present embodiment, since the discharge port and the water pump are positioned at one side of the second flow path in the suction flow path, there is an advantage that the length of the water supply flow path is minimized.

In addition, according to the present embodiment, since the connector to which the branch tubes are connected is positioned at the upper portion of the second flow path, substantially the same amount of water can be supplied to each of the rotation cleaning portions.

What is claimed is:

1. A nozzle for a cleaner comprising:

a nozzle main body including a suction flow path for suctioning air, and a flow path forming portion disposed at a center of the nozzle main body to cover the suction flow path, wherein the flow path forming portion defines a front-rear suction flow path extending in a front and rear direction relative to the nozzle main body;

a first rotation plate and a second rotation plate arranged on a lower side of the nozzle main body and spaced apart from each other in a left and right direction of the nozzle main body, each of the first rotation plate and the second rotation plate supporting a mop;

a first driving motor configured to drive the first rotation plate, the first driving motor being disposed to be spaced apart to a left outside from an outer surface of the flow path forming portion;

a second driving motor configured to drive the second rotation plate, the second driving motor being disposed to be spaced apart to a right outside from the outer surface of the flow path forming portion;

a water tank coupled to the nozzle main body, the water tank being configured to store water to be supplied to each of the first and second rotation plates; and a water supply flow path configured to supply water from the water tank to an upper surface of each of the first and second rotation plates, the water supply flow path being formed in the nozzle main body to be spaced apart from the first driving motor and the second driving motor, the water supply flow path being formed to supply the water from vertically above the upper surfaces to block water discharged from the water supply flow path from being sucked into the suction flow path, wherein the water supply flow path includes:

a first injection nozzle positioned spaced apart to the left outside from the outer surface of the flow path forming portion so that water in the water tank falls on the upper surface of the first rotation plate, the first injection nozzle being disposed to be spaced apart in a vertical direction to face the first rotation plate; and a second injection nozzle positioned spaced apart to the right outside from the outer surface of the flow path forming portion so that water in the water tank falls on the upper surface of the second rotation plate, the second injection nozzle being disposed to be spaced apart in the vertical direction to face the second rotation plate, wherein the first and the second injection nozzles are provided at end portions of the water supply flow path, and pass through a lower surface of the nozzle main body, and are exposed to an outside of the nozzle main body, wherein the nozzle main body further comprises a groove for the first and second injection nozzles having a recessed form configured for positioning each respective injection nozzle exposed to the outside of the nozzle main body, and wherein a nozzle hole through which each respective injection nozzle passes is formed in each groove.

2. The nozzle of claim 1, wherein the suction flow path comprises:

a first flow path extending in the left and right direction at a front end portion of the nozzle main body, and the front-rear suction flow path extending in the front and rear direction at a central portion of the first flow path, wherein the first and second driving motors are positioned behind the first flow path, and wherein the front-rear suction flow path is positioned between the first driving motor and the second driving motor.

3. The nozzle of claim 2, wherein the first and second rotation plates are disposed behind the first flow path.

4. The nozzle of claim 2, wherein a central axis bisecting a length from a front to a rear of the nozzle main body is positioned closer to a rotational center of each of the first and second rotation plates than to the first flow path.

5. The nozzle of claim 1, wherein the first driving motor has a first motor axis and the second driving motor has a second motor axis, and wherein the first motor axis and the second motor axis are arranged to extend in the front and rear direction.

6. The nozzle of claim 5, wherein an imaginary line connecting the first motor axis and the second motor axis passes through the front-rear suction flow path.

7. The nozzle of claim 5, wherein the first motor axis is arranged perpendicular to a rotation axis of the first rotation plate, wherein the second motor axis is arranged perpendicular to a rotation axis of the second rotation plate, and wherein the first motor axis and the second motor axis are disposed lower than an uppermost end of the flow path forming portion.

8. The nozzle of claim 1, wherein the nozzle main body is configured to receive each of the first and second driving motors, wherein the nozzle main body comprises driving unit covers that protrude upward and cover the first and second driving motors, respectively, and wherein a portion of the water tank surrounds a periphery of the driving unit covers when the water tank is mounted on the nozzle main body.

9. The nozzle of claim 8, wherein the nozzle main body further comprises:

a nozzle base on which each of the first and second driving motors is seated, and a nozzle cover coupled to the nozzle base to the flow path forming portion and including each of the driving unit covers, and wherein the water tank comprises a receiving space having a recessed form configured to receive each of the driving unit covers.

10. The nozzle of claim 1, wherein a portion of the water tank is positioned on both sides of the flow path forming portion.

11. The nozzle of claim 1, wherein the water tank comprises:

a first chamber positioned above the first driving motor;

a second chamber positioned above the second driving motor; and a connection chamber connecting the first chamber and the second chamber in a region between the suction flow path and each of the first and second driving motors.

12. The nozzle of claim 1, wherein the mop is attached to a lower surface of each of the rotation plates, and wherein each of the rotation plates is provided with a plurality of water passage holes for allowing water to be discharged from the water supply flow path to pass therethrough.

13. The nozzle of claim 12, wherein the plurality of water passage holes are arranged to be circumferentially spaced apart from each other with respect to a rotation center of each of the rotation plates.

14. The nozzle of claim 1, wherein the water supply flow path further comprises:

a supply pipe fluidly connected to the water tank, a connector connected to the supply pipe, a first branch tube connected to the connector and configured to supply water to the first rotation plate, and a second branch pipe connected to the connector and configured to supply water to the second rotation plate.

15. The nozzle of claim 14, further comprising:

a water pump for controlling water supply in the water supply flow path; and a pump motor connected to the water pump, wherein the supply pipe comprises a first supply pipe connected to an inlet of the water pump, and a second supply pipe connected to an outlet of the water pump and the connector.

16. The nozzle of claim 15, wherein the front-rear suction flow path divides the nozzle main body into a left portion and a right portion, and wherein a discharge port and the water pump are positioned on one of the left and right portions.

17. The nozzle of claim 16, wherein the connector is positioned directly above the front-rear suction flow path.

18. The nozzle of claim 1, wherein the first and the second injection nozzles are positioned to be spaced apart in a radial direction from a rotation axis of the first rotation plate or a rotation axis of the second rotation plate.

* * * * *